US010098395B2

(12) United States Patent
Baschak et al.

(10) Patent No.: US 10,098,395 B2
(45) Date of Patent: Oct. 16, 2018

(54) AIR DUCT VENTILATION SYSTEM FOR APPAREL ITEMS

(71) Applicant: NIKE, Inc., Beaverton, OR (US)

(72) Inventors: Kim D. Baschak, Portland, OR (US); Iustinia Koshkaroff, Portland, OR (US); Phyllis Michele Lininger, Beaverton, OR (US); Luke A. Pezzimenti, Portland, OR (US); Stephanie J. Scott, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 188 days.

(21) Appl. No.: 15/231,010

(22) Filed: Aug. 8, 2016

(65) Prior Publication Data

US 2017/0105466 A1 Apr. 20, 2017

Related U.S. Application Data

(60) Provisional application No. 62/242,778, filed on Oct. 16, 2015, provisional application No. 62/242,781, filed on Oct. 16, 2015.

(51) Int. Cl.
*A41D 27/00* (2006.01)
*A41D 27/28* (2006.01)

(52) U.S. Cl.
CPC ..... *A41D 27/28* (2013.01); *A41D 2400/20* (2013.01); *A41D 2400/60* (2013.01); *A41D 2500/50* (2013.01)

(58) Field of Classification Search
CPC ..... A41D 27/28; A41D 2400/60; A41D 2400/20; A41D 2500/50
See application file for complete search history.

(56) References Cited

U.S. PATENT DOCUMENTS 1,338,098 A 4/1920 Schneider
1,525,322 A 2/1925 Post
1,982,845 A * 12/1934 Wagman ..... A45C 3/06 383/33
2,160,682 A 5/1939 Silber
2,170,339 A 8/1939 Reeves
2,264,314 A 12/1941 Johns
(Continued)

FOREIGN PATENT DOCUMENTS

DE 8704993 U1 6/1987
FR 2784868 B1 4/2000
(Continued)

OTHER PUBLICATIONS

International Search Report and Written Opinion dated Nov. 15, 2016 for International Patent Application No. US2016/047077, 15 pages.
(Continued)

*Primary Examiner* — Khaled Annis
(74) *Attorney, Agent, or Firm* — Shook, Hardy and Bacon LLP

(57) ABSTRACT

An apparel item having an integrated duct system for an upper torso of a wearer is provided herein. The integrated duct may be formed by permanently and discontinuously affixing a portion of the panels used to form the apparel item along their edges. Inflow air ducts may be positioned on the front of the apparel item and outflow air ducts may be positioned on the back of the apparel item.

19 Claims, 11 Drawing Sheets

(56) References Cited

U.S. PATENT DOCUMENTS

| | | | | |
|---|---|---|---|---|
| 2,686,913 | A | 8/1954 | Brierley | |
| 3,045,243 | A * | 7/1962 | Lash | A41D 27/28 2/1 |
| 3,496,572 | A | 2/1970 | Herzig | |
| 3,698,014 | A | 10/1972 | Cebula | |
| 4,170,793 | A | 10/1979 | O'Brien | |
| 4,513,451 | A * | 4/1985 | Brown | A41D 27/285 2/102 |
| 4,810,559 | A | 3/1989 | Fortier et al. | |
| D319,113 | S | 8/1991 | Adams | |
| 5,097,534 | A | 3/1992 | Viemeister et al. | |
| 5,274,850 | A | 1/1994 | Aldridge | |
| 5,388,270 | A | 2/1995 | Hewitt | |
| 5,504,944 | A | 4/1996 | Bromer et al. | |
| 5,704,064 | A * | 1/1998 | van der Sleesen | A41D 27/28 2/108 |
| 5,727,256 | A * | 3/1998 | Rudman | A41D 27/28 2/115 |
| 5,794,265 | A | 8/1998 | Reich | |
| 5,867,825 | A | 2/1999 | Scheerer et al. | |
| 5,913,408 | A | 6/1999 | Shanahan | |
| 6,076,189 | A | 6/2000 | Christman et al. | |
| 6,122,772 | A | 9/2000 | De Guzman | |
| 6,263,511 | B1 * | 7/2001 | Moretti | A41D 27/28 2/410 |
| 6,332,221 | B1 | 12/2001 | Gracey | |
| 6,339,845 | B1 * | 1/2002 | Burns | A41D 27/28 2/108 |
| D457,709 | S | 5/2002 | Davis | |
| 6,449,772 | B1 | 9/2002 | Donner | |
| 6,654,963 | B2 | 12/2003 | Fayle et al. | |
| 6,665,878 | B1 | 12/2003 | Way | |
| 6,766,565 | B2 * | 7/2004 | Crye | A41D 27/28 24/104 |
| 6,874,162 | B2 | 4/2005 | Boezi | |
| 6,996,847 | B2 | 2/2006 | Anderson et al. | |
| 7,043,766 | B1 | 5/2006 | Foreman et al. | |
| 7,310,825 | B2 | 12/2007 | St-Germain et al. | |
| 7,380,286 | B1 | 6/2008 | Bryant, Sr. | |
| 7,418,740 | B2 | 9/2008 | Anderson et al. | |
| 7,428,772 | B2 | 9/2008 | Rock | |
| 7,540,037 | B1 * | 6/2009 | Bittler | A41D 13/0543 2/69 |
| 7,568,238 | B2 | 8/2009 | Schossberger et al. | |
| 7,779,485 | B2 | 8/2010 | Gandy | |
| 8,133,824 | B2 | 3/2012 | Harber | |
| D657,532 | S | 4/2012 | Gaeir et al. | |
| 8,438,665 | B2 | 5/2013 | Roemer et al. | |
| 8,453,264 | B2 | 6/2013 | Mickle et al. | |
| 8,453,270 | B2 | 6/2013 | Blackford | |
| D707,974 | S | 7/2014 | Blackford | |
| 8,850,615 | B2 | 10/2014 | Demarest et al. | |
| D720,119 | S | 12/2014 | Pankhurst et al. | |
| 8,910,313 | B2 | 12/2014 | Gordon et al. | |
| 9,009,865 | B2 | 4/2015 | Gilreath | |
| 9,060,551 | B2 | 6/2015 | Nordstrom et al. | |
| 9,062,913 | B2 | 6/2015 | Araujo et al. | |
| 2003/0140404 | A1 * | 7/2003 | Golde | A41D 27/28 2/465 |
| 2004/0064870 | A1 | 4/2004 | Gold | |
| 2004/0237168 | A1 * | 12/2004 | Braun | A41D 27/28 2/93 |
| 2005/0172378 | A1 | 8/2005 | Messiou | |
| 2005/0172381 | A1 * | 8/2005 | Bush | A41D 27/28 2/249 |
| 2005/0273903 | A1 * | 12/2005 | Rudman | A41B 1/08 2/69 |
| 2006/0179539 | A1 | 8/2006 | Harber | |
| 2006/0277652 | A1 | 12/2006 | Okajima | |
| 2007/0118960 | A1 | 5/2007 | Goodwin | |
| 2008/0040832 | A1 * | 2/2008 | Bay | A41D 27/28 2/93 |
| 2009/0077710 | A1 * | 3/2009 | Bay | A41D 3/00 2/87 |
| 2011/0131704 | A1 | 6/2011 | Hughes | |
| 2011/0225699 | A1 | 9/2011 | Elhamsadat et al. | |
| 2011/0239350 | A1 | 10/2011 | Ho et al. | |
| 2011/0265242 | A1 | 11/2011 | Lambertz | |
| 2013/0269082 | A1 | 10/2013 | Bramblet | |
| 2014/0007314 | A1 | 1/2014 | Davis et al. | |
| 2014/0059736 | A1 | 3/2014 | Mccuaig | |
| 2014/0250565 | A1 | 9/2014 | Willows et al. | |
| 2014/0259268 | A1 * | 9/2014 | Fier | E04H 15/16 2/69 |
| 2014/0259276 | A1 * | 9/2014 | Fier | A41D 1/00 2/85 |
| 2014/0373248 | A1 | 12/2014 | Demarest et al. | |
| 2015/0033451 | A1 | 2/2015 | Bradshaw | |

FOREIGN PATENT DOCUMENTS

| | | | |
|---|---|---|---|
| JP | S61199517 | U | 12/1986 |
| JP | H02131515 | U | 11/1990 |
| JP | 2003293205 | A | 10/2003 |
| JP | 3134972 | U | 8/2007 |
| JP | 2011117121 | A | 6/2011 |
| JP | 2012255242 | A | 12/2012 |
| JP | 2013122095 | A | 6/2013 |
| WO | 2013171477 | A1 | 11/2013 |
| WO | 2015034722 | A1 | 3/2015 |

OTHER PUBLICATIONS

International Preliminary Report on Patentability dated Aug. 31, 2017 in International Patent Application No. PCT/US2016/018708, 13 pages.

"Men's Quantum Short-Sleeve T-Shirt," Eddie Bauer, eddiebauer.com, Accessed: Jul. 2015. http://www.eddiebauer.com/product/quantum-short-sleeve-t-shirt/12950204/_/A-ebSku_0290805100000060_12950204_catalog10002_en_US?showProducts=111&backToCat=&previousPage=SRC&tab=&color=511.

"X-Bionic: Patriot Energy Accumulator Ski Shirt," Luisaviaroma, luisaviaroma.com, Accessed: Jul. 2015. http://www.luisaviaroma.com/index.aspx?#ItemSrv.ashx|SeasonId=60I&CollectionId=DM1&ItemId=1&VendorColorId=VDAxOA2&SeasonMemoCode=actual&GenderMemoCode=men&Language=&CountryId=&SubLineMemoCode=clothing&CategoryId=0&ItemResponse=&MenuResponse=&SizeChart=false&ItemTag=true&NoContext=false.

"C8 Jersey Specifications," Dye, creativesrg.com, Accessed: Jul. 2015. http://www.creativesrg.com/demos/dye/C8Jerseys/specs.html.

"Fuse Jersey," Bellwether Cyclewear®, bellwetherclothing.com, Accessed: Jul. 2015. http://www.bellwetherclothing.com/mens/jerseysandtops/fuse/.

"What I'm Riding: Rapha Winter Jersey," Cycle Boredom, cycleboredom.com, Apr. 26, 2012. http://www.cycleboredom.com/what-im-riding-rapha-winter-jersey/.

"Rondoy Down Jacket: K Series," PHD, phdesigns.co.uk, Accessed: Jul. 2015. http://www.phdesigns.co.uk/rondoy-down-jacket-k-series.

Allen, Dana, "Mountain Equipment Eclipse Hooded Zip Tee," blister, blistergearreview.com, Oct. 4, 2013. http://blistergearreview.com/gear-reviews/mountain-equipment-eclipse-hooded-zip-tee.

"Cyclic Zip Neck Women's," Arc'Teryx, arcteryx, © 2015, accessed: Aug. 2015. http://arcteryx.com/product.aspx?language=EN&gender=womens&category=shirts_and_tops&model=Cyclic-Zip-Neck-W.

JJ, "Ortovox Merino Fleece Hoody," YMMV Reviews, ymmvreviews.com, © 2015, accessed: Aug. 2015. http://ymmvreviews.com/clothing/ortovox-merino-fleece-hoody/.

"Trans4m™ Thermal Plus™ Run Glove," Amphipod, Inc., amphipod.com, © 2015, accessed: Aug. 2015. http://www.amphipod.com/products/trans4m-thermal-plus-run-glove.

Debra, Kitsilano, "Lululemon Pumpkin Orange Long Sleeve Turkey Trot Technical Running Shirt Top 205," goodoldlululemon.wordpress.com, Feb. 8, 2013. https://goodoldlululemon.wordpress.com/2013/02/08/lululemon-pumpkin-orange-long-sleeve-turkey-trot-technical-running-shirt-top-205/.

(56) References Cited

OTHER PUBLICATIONS

International Search Report and Written Opinion dated Aug. 3, 2016 for International Patent Application No. PCT/US2016/018708, 19 pages.

* cited by examiner

AIR DUCT VENTILATION SYSTEM FOR APPAREL ITEMS

CROSS-REFERENCE TO RELATED APPLICATIONS

This application entitled "Air Duct Ventilation System for Apparel Items," claims priority to U.S. Prov. App. No. 62/242,781, entitled "Air Duct Ventilation System for Apparel Items," and filed Oct. 16, 2015, and U.S. Prov. App. No. 62/242,778, entitled "Cold-Weather Apparel Item," and filed Oct. 16, 2015. The entireties of the aforementioned applications are incorporated by reference herein.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

At a high level, aspects herein are directed to an apparel item for an upper torso of a wearer, such as a jacket or top, having an integrated duct system where the apparel item is configured to provide protection from the elements such as cold and/or rain while still facilitating air exchange between the external environment and the interior of the jacket. The apparel item as described herein may be especially suitable for wear by athletes that participate in vigorous outdoor activities such as running, skiing, and the like. These types of athletes often produce large amounts of body heat and/or perspiration and the apparel item as described herein helps the athlete to dissipate the heat and/or moisture vapor associated with the perspiration while still providing adequate protection from the elements.

In one exemplary aspect, the integrated duct system described herein may be formed by discontinuously affixing a portion of the panels used to form the apparel item along their edges. For instance, inflow air ducts may be formed on the front of the apparel item by discontinuously affixing front edges of right and left sleeve panels to upper edges of one or more front panels of the apparel item. In addition to, or alternatively, inflow air ducts may be formed on the front of the apparel item by discontinuously affixing a lower edge of an upper front panel to an upper edge of a lower front panel. In those instances when the front of the apparel item comprises multiple panels, inflow air ducts may be formed between some or all of the panels. In yet another exemplary aspect, inflow air ducts may be formed on the front of the apparel item by forming a re-sealable pocket having a mesh-like fabric on the interior of the pocket, where the pocket may function as an inflow air duct when the pocket is in an open position. By having the pocket be re-sealable, the amount of ventilation associated with the apparel item may be adjusted to provide more or less ventilation.

Continuing, one or more outflow air ducts may be formed on the back of the apparel item by discontinuously affixing, for instance, a lower edge of an upper back panel to an upper edge of a lower back panel. Moreover, when the back of the apparel item comprises multiple panels, outflow air ducts may be formed between some or all of the panels. In exemplary aspects, the outflow air duct located on the back of the apparel item is configured to be larger in size (i.e., to have a larger volume) than the inflow air ducts located on the front of the apparel item and to have a horizontal orientation such that the outflow air duct extends across a midline of the back of the apparel item.

Further, for at least a portion of the air ducts, in the areas where the panel edges are discontinuously affixed, at least one of the panel edges may be reinforced along its entire length with a rigid or semi-rigid reinforcing strip having a shape that causes the panel edge to which it is affixed to extend away from the surface of the apparel item. In exemplary aspects, the strip is affixed to the panel edge that forms the superior or upper margin of the duct. For example, for inflow air ducts located on the front of the apparel item that are created by discontinuously affixing the front edges of the right and left sleeve panels to the upper edges of the front panels, the strip may be affixed to the front edges of the right and left sleeve panels as these form the superior margin of these inflow air ducts. In another example, for the outflow air duct located on the back of the apparel item, the strip may be affixed to the lower edge of the upper back panel as this edge forms the superior margin of the outflow air duct. Use of the strip maintains the air ducts in a permanently open position. By maintaining the inflow and/or the outflow air ducts in a permanently open position, an effective air flow pattern can be achieved and maintained despite different orientations and/or movements associated with the wearer of the apparel item.

BRIEF DESCRIPTION OF THE DRAWINGS

The present invention is described in detail below with reference to the attached drawing figures, wherein.

DETAILED DESCRIPTION

Figure 1:
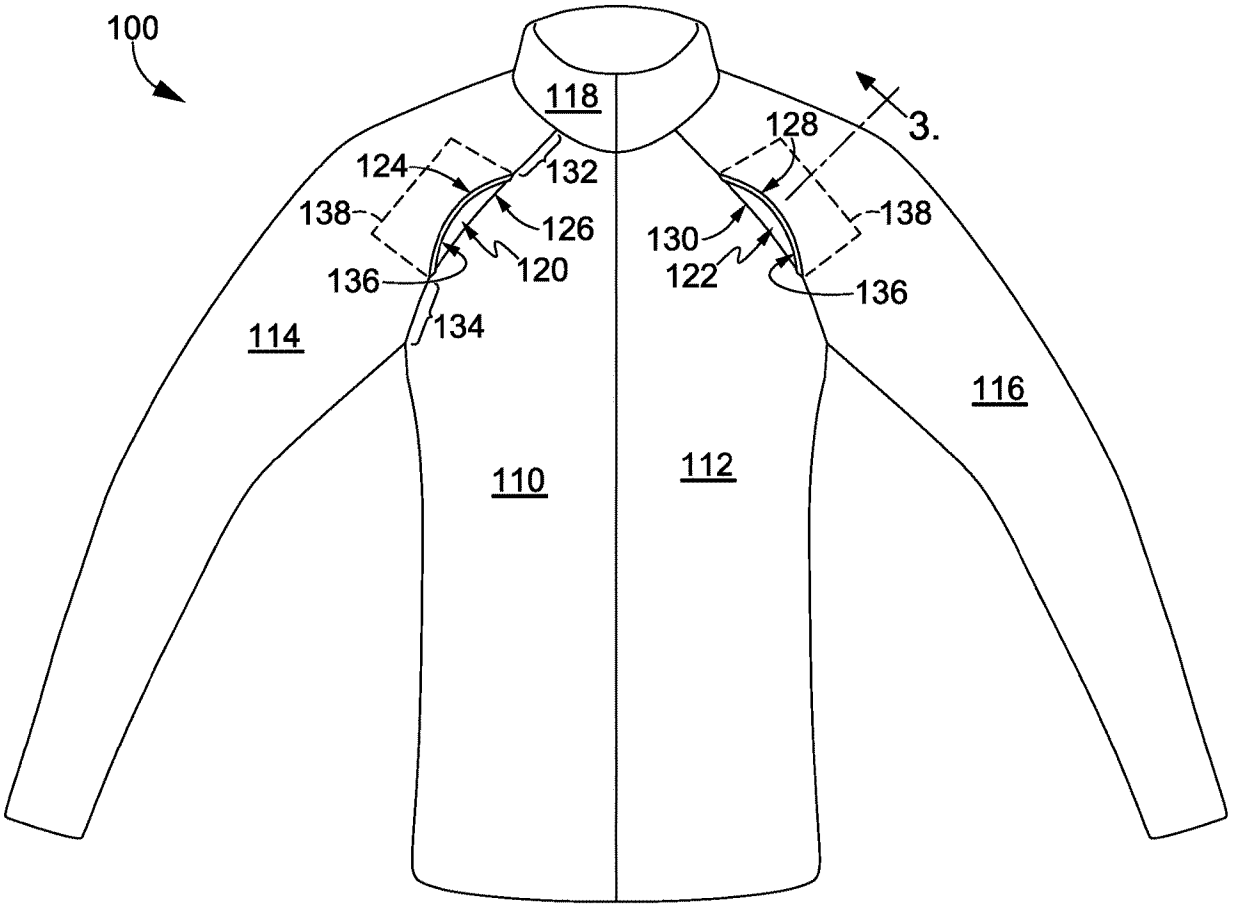
FIG. 1 depicts a front view of an exemplary apparel item having an integrated duct system in accordance with aspects herein.

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Aspect herein provide for an apparel item for an upper torso of a wearer, such as a jacket or top, having an integrated duct system where the apparel item is configured to provide protection from the elements such as cold and/or rain while still facilitating air exchange between the external environment and the interior of the apparel item. In exemplary aspects, the integrated duct system described herein may be formed by discontinuously affixing a portion of the panels used to form the apparel item along their edges. For instance, in one aspect, inflow air ducts may be formed on the front of the apparel item by discontinuously affixing front edges of right and left sleeve panels to upper edges of one or more front panels of the apparel item. Alternatively, or in addition to, inflow air ducts may be formed on the front of the apparel item by affixing a lower edge of an upper front panel to an upper edge of a lower front panel. Additional inflow air ducts maybe formed between adjacent panels when the front of the apparel item comprises multiple different panels. In another exemplary aspect, inflow air ducts may be formed on the front of the apparel item by, for instance, configuring one or more re-sealable pockets having a mesh or perforated lining. When additional ventilation is desired, the pocket(s) can be opened and may then function as an inflow air duct. Any and all aspects, and any variation thereof, are contemplated as being within the scope herein.

Continuing, one or more outflow air ducts may be formed on the back of the apparel item by, for example, discontinuously affixing a horizontally-oriented lower edge of an upper back panel to a horizontally-oriented upper edge of a lower back panel. This results in the outflow air duct having a generally horizontal orientation, where the outflow air duct extends across the midline of the back of the apparel item. Other outflow air ducts may be formed in a similar manner when the back of the apparel item is formed from multiple different panels. In exemplary aspects, the outflow air duct located on the back of the apparel item is configured to be larger in size than the inflow air ducts located on the front of the apparel item.

Moreover, for at least a portion of the air ducts, in the areas where the panel edges are discontinuously affixed, at least one of the panel edges may be reinforced along its entire length with a rigid or semi-rigid reinforcement strip having a first end, a second end, and an intervening portion extending between the first and second ends. In exemplary aspects, the strip is affixed to the panel edge that forms the superior margin of the duct. For example, for the inflow air ducts located on the front of the apparel item that are formed by discontinuously affixing panel edges, a reinforcement strip may optionally be affixed to, for instance, the front edges of the right and left sleeve panels, or the lower edges of the upper front panels, as these edges form the superior margin of the respective inflow air ducts. For the outflow air duct located on the back of the apparel item, the reinforcement strip may be affixed to, for instance, the lower edge of the upper back panel as this edge forms the superior margin of the outflow air duct.

In exemplary aspects, the reinforcement strip has a preformed shape such that when affixed to the panel edge, the first and second ends of the strip are flush with the outer-facing surface of the apparel item, and the midpoint of the strip is positioned a predetermined distance away from the outer-facing surface of the apparel item. The result of this is an air duct that is maintained in a permanently open position and that is formed to have a configuration that is optimized for capturing and/or funneling air into and out of the apparel item. Thus, by using the reinforcement strip to maintain the inflow and/or the outflow air ducts in a permanently open position and to impart a scooped-shape to the air ducts, an effective air flow pattern can be achieved and maintained despite different orientations and/or movements associated with the wearer of the apparel item.

The use of the reinforcement strip along with the orientation of the inflow and outflow air ducts may help to create several air flow patterns. For example, by orientating the inflow air ducts in a generally diagonal orientation along an upper front portion of the apparel item, the inflow air ducts may be effective to help trap and funnel air traveling over and up the front of the apparel item. This effect may be augmented by use of the reinforcement strip to maintain some or all of the inflow air ducts in a permanently open configuration. The orientation of the inflow air ducts may be especially effective in funneling air when the apparel item is being worn by a runner, as runners often produce significant air flow over and up their front torsos by their relatively fast movement in a forward direction. As well, by configuring the outflow air duct on the back of the apparel item to be larger in size than the inflow air ducts, and by using the reinforcement strip to maintain the outflow air duct in a permanently open position, a large egress point is provided for air exiting the apparel item.

The configuration of the inflow and outflow air ducts as described creates an air flow pattern from the inflow air ducts to the outflow air duct, thereby allowing air to circulate in the space created between the apparel item and the wearer's body where it can cool the wearer and help pick up moisture vapor produced by the wearer. More specifically, positive air pressure may be created at the inflow air ducts by air flowing into the ducts. And negative air pressure may be created at the outflow air duct on the back of the apparel item due to the larger size of the outflow air duct as compared to the inflow air ducts, and because air is generally not flowing into the outflow air duct. Air flows along this pressure differential from the front of the apparel item to the back of the apparel item where it then escapes the apparel item. As described, this air circulation pattern may be useful in dissipating body heat and/or transporting moisture vapor away from the wearer.

Besides the movement of air caused by the pressure differentials between the inflow and outflow air ducts, the configuration of the outflow air duct on the back of the apparel item may produce an additional air flow pattern based on Bernoulli's principle that may further facilitate air movement through the apparel item. More specifically, by having, for instance, an arched-shaped reinforcement strip affixed to the lower edge of the upper back panel, a downward-facing scoop is formed having an aerofoil-type shape. Air flowing over the outer-facing surface of the shoulders and back of the apparel item—as would be caused by, for example, a running motion when the apparel item is worn—would subsequently travel over the outer-facing surface of the downward-facing scoop. Because of the aerofoil-type shape of the outflow air duct, air would flow faster over the outer-facing surface of the outflow air duct and slower underneath the duct. The faster moving air causes a lower air pressure while the slower moving air causes a higher air pressure. The slower moving air—the air exiting the outflow duct from the interior of the apparel item—will generally speed up in order to equalize the pressure differential thereby further helping to draw or channel air out of the apparel item.

Figure 2B:
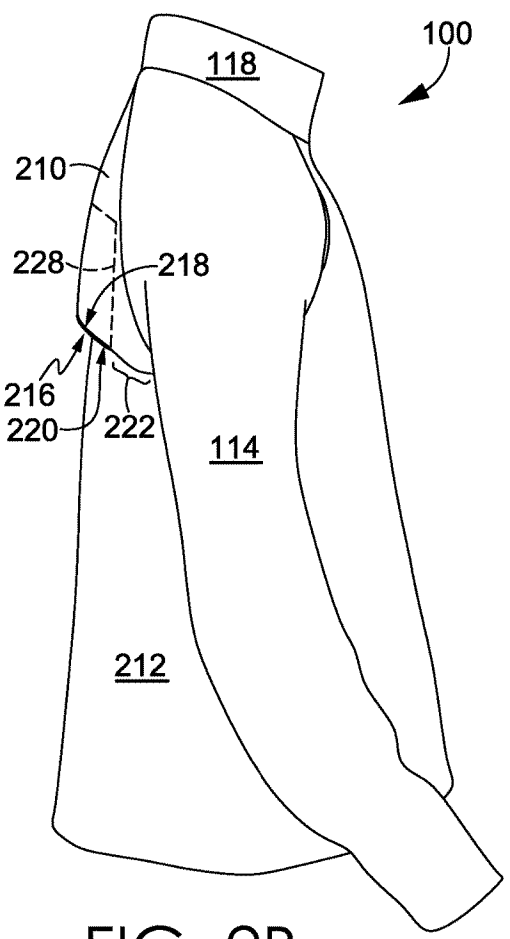
FIG. 2B depicts a right side view of the exemplary apparel item having the integrated duct system of FIGS. 1 and 2A in accordance with aspects herein.
Figure 2A:
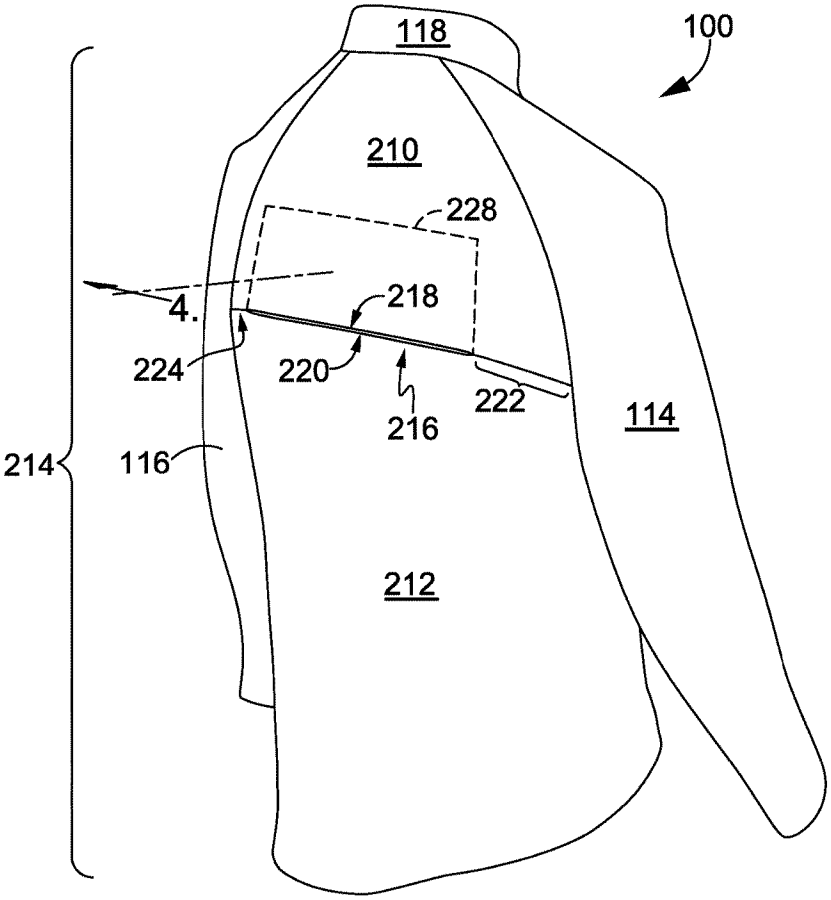
FIG. 2A depicts a back perspective view of the exemplary apparel item having the integrated duct system of FIG. 1 in accordance with aspects herein.

Turning now to FIGS. 1 and 2A, FIGS. 1 and 2A depict a front view and a back perspective view respectively of an exemplary apparel item 100 having an integrated duct system in accordance with aspects herein. In general, the apparel item 100 is configured for an upper torso of a wearer when worn. Further, although shown as a jacket, it is contemplated herein that the apparel item 100 may be in the form of a coat, a shirt or top, a pullover, and the like. Moreover, the sleeves shown on the apparel item 100 may have lengths other than the full-length sleeve as shown. For instance, the sleeves may be three-quarter sleeves, half-sleeves, quarter sleeves, and the like.

In exemplary aspects and as shown in FIG. 1, the apparel item 100 comprises at least a front right panel 110 adapted to cover a right front torso area of a wearer when the apparel item 100 is worn and a front left panel 112 adapted to cover a left front torso area of the wearer when the apparel item 100 is worn. The front right panel 110 and the front left panel 112 may, in exemplary aspects, be releasably secured to one another via, for example, a zipper-type mechanism. Continuing, the apparel item 100 further comprises a right sleeve panel 114 adapted to cover a right arm of the wearer when the apparel item 100 is worn, and a left sleeve panel 116 adapted to cover a left arm of the wearer when the apparel item 100 is worn. The apparel item 100 may additionally comprise, for instance, a collar panel 118, a hood, cuff panels, and/or a waistband panel (not shown). Additional front panels besides those shown in FIG. 1 are contemplated herein as will be described with respect to, for example, FIG. 14.

As shown in FIG. 2A, the apparel item 100 further comprises an upper back panel 210 and a lower back panel 212 that together form a full back panel 214 for the apparel item 100, where the back panel 214 is adapted to cover a back torso area of the wearer when the apparel item 100 is worn. More specifically, the upper back panel 210 may be configured to cover a shoulder and upper back area of the wearer, and the lower back panel 212 may be configured to cover a lower back area of the wearer when the apparel item 100 is worn.

Figure 10:
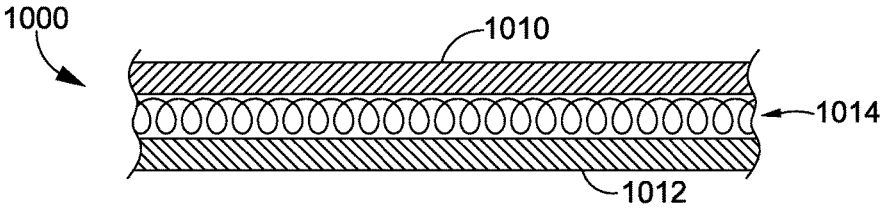
FIG. 10 depicts a cross-sectional view of an exemplary composite fabric used to form one or more portions of an apparel item having an integrated duct system in accordance with aspects herein.

In exemplary aspects, one or more of the front right panel 110, the front left panel 112, the right sleeve panel 114, the left sleeve panel 116, the upper back panel 210, and/or the lower back panel 212 may be formed from a composite fabric such as the composite fabric shown in FIG. 10 and referenced generally by the numeral 1000. In exemplary aspects, the composite fabric 1000 may comprise a face fabric 1010, a backer fabric 1012, and an air-permeable membrane 1014 sandwiched between or interposed between the face fabric 1010 and the backer fabric 1012. In exemplary aspects, the face fabric 1010 may be affixed to the backer fabric via, for example, an adhesive. For example, the face fabric 1010 may be affixed to the membrane 1014 via the adhesive, and the backer fabric 1012 may be affixed to the membrane 1014 via the adhesive to form the composite fabric 1000. Moreover, in exemplary aspects the adhesive may be applied as a dot matrix or other type of discontinuous pattern at discrete locations on the face fabric 1010 and/or backer fabric 1012. By selectively applying the adhesive at discrete locations, as opposed to coating the entire surface of the face fabric 1010 and/or backer fabric 1012 with a film of adhesive, permeability characteristics of the composite fabric 1000 may be increased. Further, by selectively applying the adhesive at discrete locations as compared to applying the adhesive as a continuous film, the composite fabric 1000 may exhibit greater pliability or flexibility.

The composite fabric 1000 may have an overall weight sufficient to withstand environmental conditions such as wind and to provide a degree of warmth to the wearer while still being light enough and having sufficient pliability to allow the wearer to engage in athletic activities. Exemplary weights for the composite fabric 1000, measured in grams/$m^2$ (grams per square meter (gsm)), may comprise between 80-220 gsm, 80-200 gsm, 80-180 gsm, or 80-160 gsm although weights above and below these ranges are contemplated herein.

In exemplary aspects, the face fabric 1010 is configured to be an outer-facing surface of the apparel item 100 when the composite fabric 1000 is incorporated into the apparel item 100. In exemplary aspects, the face fabric 1010 may be treated with a durable water repellent (DWR) finish making the face fabric 1010 impermeable or substantially impermeable to water. In some exemplary aspects, the face fabric 1010 may comprise a woven fabric. In other exemplary aspects, the face fabric 1010 may comprise a knit fabric. Use of a knit fabric as the face fabric 1010 may cause the apparel item 100 to have increased permeability or breathability characteristics.

In additional exemplary aspects, the face fabric 1010 may comprise a Jacquard knit pattern on certain portions of the apparel item 100. For example, a Jacquard knit pattern may be used on the back panel 214 of the apparel item 100. In general, the Jacquard pattern may be knit to have a more open knit structure as compared to portions of the face fabric 1010 not having the Jacquard pattern. For instance, the Jacquard pattern may comprise apertures or perforations integrally formed in the knit structure. The open knit structure may cause the apparel item 100 to be more breathable in the areas where the Jacquard pattern is located. For example, the lower back panel 212 of the apparel item 100 is generally configured to overlie a back torso area of the wearer when the apparel item 100 is worn. This area typically produces a lot of heat during athletic activities. By having the Jacquard knit pattern in this area, the heat and/or moisture vapor may be dissipated more quickly.

Further, in exemplary aspects, the size of the apertures or perforations of the Jacquard pattern may be based on heat or sweat map data such that larger-sized perforations or apertures may be positioned in regions corresponding to high-heat or high-sweat generating regions of the wearer while smaller-sized perforations may be positioned in regions corresponding to relatively low-heat or low-sweat generating regions of the wearer. Additionally, a gradient in apertures size may be utilized when transitioning from the larger-sized apertures to the smaller-sized apertures. Any and all aspects, and any variation thereof, are contemplated as being within the scope herein.

It is contemplated herein that the Jacquard knit pattern may be used at other locations of the apparel item 100 where increased breathability characteristics are needed. In exemplary aspects, an air-permeable membrane, such as the membrane 1014, and a backer fabric, such as the backer fabric 1012 may underlay the Jacquard knit pattern.

With continued reference to FIG. 10, the backer fabric 1012 is configured to be an inner-facing surface of the apparel item 100 when the composite fabric 1000 is incorporated into the apparel item 100. In exemplary aspects, the backer fabric 1012 may comprise a knit or woven fabric. Moreover, it is contemplated herein that both the face fabric 1010 and the backer fabric 1012 may comprise a knit fabric. Having such a configuration may increase the overall permeability characteristics of the composite fabric 1000 due to the generally looser knit structure versus woven structure. It is further contemplated herein that the face fabric 1010 may comprise a knit fabric while the backer fabric 1012 may comprise a woven fabric, or the face fabric 1010 may comprise a woven fabric while the backer fabric 1012 may comprise a knit fabric. As well, it is contemplated herein that both the face fabric 1010 and the backer fabric 1012 may comprise a woven fabric. Any and all aspects, and any variation thereof, are contemplated was being within the scope herein.

The air-permeable membrane 1014, in exemplary aspects, may comprise a material that is substantially impervious to liquid water but permits water vapor and/or air to pass through. This property helps to make the composite fabric 1000 useful for outdoor activities where a wearer may generate large amounts of body heat and/or perspiration while potentially being exposed to rain and/or snow. The membrane 1014 would help to prevent the precipitation from reaching the skin of the wearer while still allowing body heat and/or moisture vapor to escape the fabric 1000.

In one exemplary aspect, the membrane 1014 may comprise a nanofiber material that is spun in a fine web by a process such as electrospinning. Further, in exemplary aspects, the nanofiber material may comprise a liquid polymer such as polyurethane (PU) or thermoplastic polyurethane (TPU) although other liquid polymer materials are contemplated as being within the scope herein.

The density of the electrospun fibers in the membrane 1014 may be variable, where the density is measured in grams/weight of electrospun film per linear yard. The density of the electrospun fibers may be changed by, for instance, slowing down the electrospinning process so that more fibers are deposited per square inch. When the density of the electrospun fibers is greater (such as, for example, greater than or equal to 9 grams/weight), this corresponds to more layers of electrospun fibers. More layers of electrospun fibers, in turn, generally cause the membrane 1014 to exhibit greater waterproof characteristics but to be less permeable to air and/or moisture vapor. Conversely, when the density of the electrospun fibers is less (such as, for example, less than or equal to 3 grams/weight), this corresponds to fewer layers of electrospun fibers. Fewer layers of electrospun fibers, in turn, generally cause the membrane 1014 to exhibit less waterproof characteristics but to be more permeable to air and/or moisture vapor.

In one exemplary aspect, the density of the membrane 1014 may be selected in conjunction with the properties of the face fabric 1010 and the backer fabric 1012 to achieve an overall level of air and/or moisture vapor permeability for the composite fabric 1000. For example, the tightness of the weave or knit of the face fabric 1010 and/or the backer fabric 1012 may be increased to reduce permeability characteristics associated with the fabrics 1010 and 1012, but the density of the membrane 1014 may be decreased to increase permeability so that a total overall permeability of the composite fabric 1000 is within a predetermined range. Conversely, the tightness of the weave or knit of the face fabric 1010 and/or the backer fabric 1012 may be decreased to increase permeability characteristics associated with the fabrics 1010 and 1012, but the density of the membrane 1014 may be increased to decrease permeability of the membrane 1014 to achieve a total overall permeability of the composite fabric 1000 that is within the predetermined range. Any and all aspects, and any variation thereof, are contemplated as being within the scope herein.

Moreover, properties of the integrated duct system such as the size and number of inflow air ducts, the size and number of outflow air ducts, and/or the use or non-use of reinforcement strips and the properties of the composite fabric 1000 such as the density of the membrane 1014, the knit or woven structure of the face fabric 1010, the knit or woven structure of the backer fabric 1012, and/or the presence or absence of a Jacquard knit pattern, may be selected to achieve an overall desired permeability of the apparel item 100.

Panels of the composite fabric 1000 having different permeability characteristics may be used on different portions of the apparel item 100 to target areas of the wearer that produce more or less moisture vapor. For instance, panels of the composite fabric 1000 used to form the front and back of the apparel item 100 may be configured to be more permeable as compared to panels of the composite fabric 1000 used to form the sleeve portions of the apparel item 100 since these portions typically overlie areas of the wearer that produce less moisture vapor as compared to the front and back torso areas of the wearer.

Turning back to FIG. 1, in one exemplary aspect the apparel item 100 may comprise at least two inflow air ducts, a first inflow air duct 120 and a second inflow air duct 122. The first inflow air duct 120 may be formed by permanently and discontinuously affixing a front edge 124 of the right sleeve panel 114 to an upper edge 126 of the front right panel 110, and the second inflow air duct 122 may be formed by permanently and discontinuously affixing a front edge 128 of the left sleeve panel 116 to an upper edge 130 of the front left panel 112.

As used throughout this disclosure, the term "affixing" when used with the word "permanent" is generally meant to encompass affixing technologies known in the art such as stitching, bonding, welding, using adhesives, and the like that may be used to permanently or non-removably attach materials together. Further, the term "discontinuously affixing" as used throughout this disclosure means that a first panel edge may be joined to a second panel edge at discrete portions, but maintained separate from each other at other segments between the joined portions in order to form a duct or opening between the panel edges. This is in contrast to a typical seam in which two panel edges are continuously joined by sewing or other bonding techniques along the length of the seam so that there are no lapses, voids, or spaces.

Thus, with respect to FIG. 1, the front edge 124 of the right sleeve panel 114 is permanently joined to the upper edge 126 of the front right panel 110 at the areas indicated by reference numerals 132 and 134 but is maintained separate from the upper edge 126 at the first inflow air duct 120. The same configuration would hold true for the left sleeve panel 116 and the front left panel 112.

In exemplary aspects, each of the first inflow air duct 120 and the second inflow air duct 122 may have an opening length between 5 cm and 20 cm, 7 cm and 15 cm, and/or between 10 cm and 13 cm, although lengths above and below these ranges are contemplated herein. Further, in one exemplary aspect, the first inflow air duct 120 may be skewed in a positive direction from a vertical axis bisecting the first inflow air duct 120, and the second inflow air duct 122 may be skewed in a negative direction from a vertical axis bisecting the second inflow air duct 122. For example, the first inflow air duct 120 may be skewed in the range of +10 degrees, +20, degrees, +30 degrees, +40 degrees, +50 degrees, and/or +60 degrees, and/or any value in between, although degrees of skewing above and below these values are contemplated herein. Similarly, the second inflow air duct 122 may be skewed in the range of −10 degrees, −20, degrees, −30 degrees, −40 degrees, −50 degrees, and/or −60 degrees, and/or any value in between, although degrees of skewing above and below these values are contemplated herein. The depiction of the orientation of the first and second inflow air ducts 120 and 122 is exemplary only, and it is contemplated that other orientations are within the scope contemplated herein.

Figure 3:
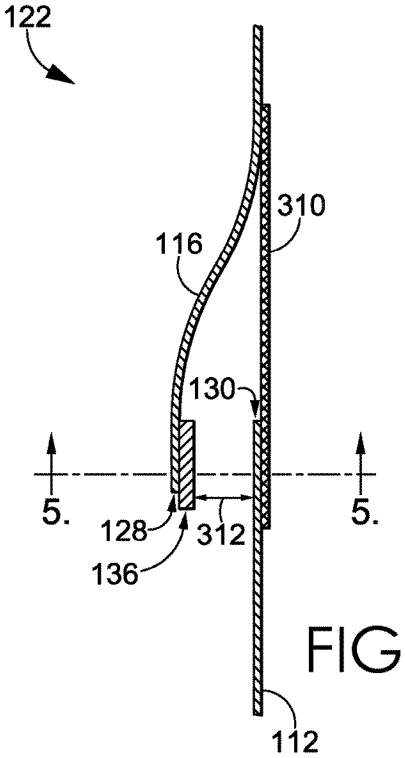
FIG. 3 depicts a cross-sectional view taken along cut line 3 of FIG. 1 illustrating an inflow air duct of the integrated duct system in accordance with aspects herein.

As will be shown and discussed in more detail with respect to FIG. 3, in an optional aspect, the front edge 124 of the right sleeve panel 114 and the front edge 128 of the left sleeve panel 116 may be reinforced with a rigid or semi-rigid reinforcement strip 136 in the areas where the front edges 124 and 128 are not joined to the upper edges 126 and 130 of the front right panel 110 and the front left panel 112 respectively (i.e., at the first inflow air duct 120 and at the second inflow air duct 122). As mentioned, use of the reinforcement strip 136 is optional, and it is contemplated herein that the first and second inflow air ducts 120 and 122 may be formed without use of the reinforcement strip 136. Any and all aspects, and any variation thereof, are contemplated as being within the scope herein.

Figure 11A:
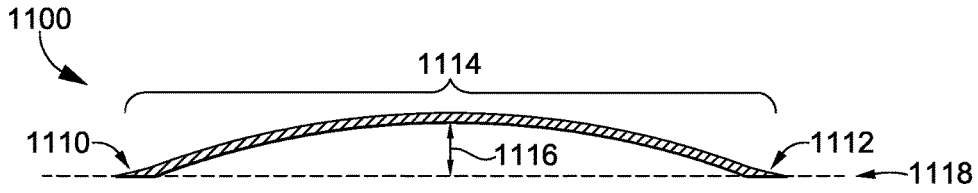
FIGS. 11A-11C depict side views of exemplary reinforcement strips used to reinforce a panel edge of an inflow or outflow air duct in accordance with aspects herein.
Figure 11B:
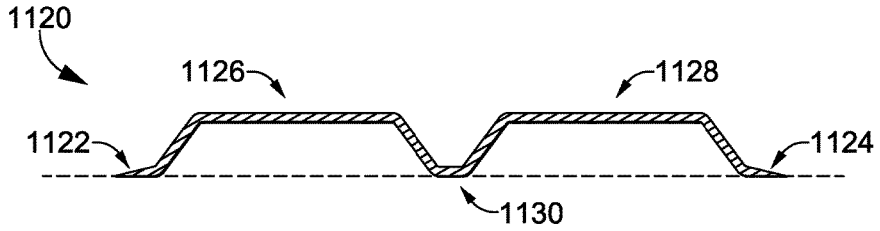
Figure 11C:
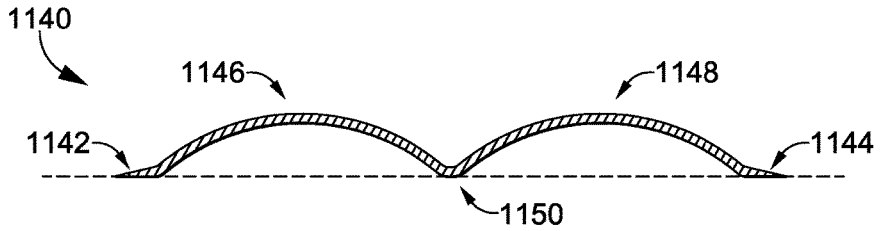

FIGS. 11A-11C depict face views of exemplary reinforcement strips 1100, 1120, and 1140 in accordance with aspects herein. The reinforcement strips shown in FIGS. 11A-11C may optionally be used in association with, for example, the first and second inflow air ducts 120 and 122, other inflow air ducts as described herein, and/or outflow air duct(s) located on the back of the apparel item 100 as will be discussed below. In exemplary aspects, the reinforcement strips depicted in FIGS. 11A-11C may be formed of a nylon material, a polyurethane material, and/or a thermoplastic polyurethane material that has a degree of rigidity or stiffness that enables the strips to maintain a defined shape in their resting state. However, it is contemplated herein, that the reinforcement strips depicted in FIGS. 11A-11C may also exhibit some degree of flexibility such that they deform upon application of an external force exceeding a predetermined minimum threshold. Other materials are contemplated herein for forming the reinforcement strips shown in FIGS. 11A-11C such as, for example, plastic materials, rubber materials, stiff fabrics, metal materials, and the like. Moreover, it is contemplated herein that the reinforcement strips shown in FIGS. 11A-11C may comprise any number of different colors. Any and all aspects, and any variation thereof, are contemplated as being within the scope herein.

With respect to FIG. 11A, in exemplary aspects, the reinforcement strip 1100 is pre-formed into an arched shape having a first end 1110, a second end 1112, and an intervening portion 1114 extending between the first end 1110 and the second end 1112. Because of its arched shape, the first and second ends 1110 and 1112 are configured to be flush with, for example, a surface 1118 (indicated by the dashed line in FIG. 11A) such as an outer-facing surface of an apparel item (e.g., the apparel item 100), and the intervening portion 1114 is configured to extend away from the surface 1118. In exemplary aspects, a midpoint of the strip 1100 is configured to extend a predetermined distance 1116 away from the surface 1118. The predetermined distance 1116 may vary depending on whether the reinforcement strip 1100 is being used in association with an inflow air duct such as the first and second inflow air ducts 120 and 122 or an outflow air duct as will be explained in greater depth below.

In exemplary aspects, the intervening portion 1114 of the reinforcement strip 1100 may have a thickness in the range of 2 mm to 5 mm, and/or between 3 mm to 4 mm although thicknesses above and below these ranges are contemplated herein. Further, in exemplary aspects, the first and second ends 1110 and 1112 may be formed to taper or have a reduced thickness as compared to remaining portions of the strip 1100. The reduced thickness may be useful in enabling the ends 1110 and 1112 to lie flush with the surface 1118. In exemplary aspects, the reinforcement strip 1100 may have a width between 0.3 cm and 1.5 cm, 0.6 cm and 1.2 cm, and/or between 0.8 cm and 1.1 cm, although widths above and below these ranges are contemplated herein.

FIG. 11B depicts an alternative shape configuration for the reinforcement strip 1120. The reinforcement strip 1120 comprises a first end 1122 and a second end 1124. Instead of having an arched shape like the reinforcement strip 1100, the reinforcement strip 1120 comprises more of a half-square or half-rectangle shape with two plateau areas 1126 and 1128 separated by a trough region 1130. The plateau areas 1126 and 1128 may extend a predetermined distance away from a surface similar to the reinforcement strip 1100, while, in exemplary aspects, the trough region 1130 may touch or nearly touch the surface. Although depicted as having two plateau areas, it is contemplated herein that the reinforcement strip 1120 may comprise just one plateau area or multiple plateau areas separated by multiple trough regions. Any and all aspects, and any variation thereof, are contemplated as being within the scope herein.

FIG. 11C depicts yet another alternative shape configuration for the reinforcement strip 1140. The reinforcement strip 1140 comprises a first end 1142 and a second end 1144. In this exemplary aspect, the reinforcement strip 1140 comprises two curved peaks 1146 and 1148 separated by a trough region 1150. The peaks 1146 and 1148 may extend a predetermined distance away from a surface similar to the reinforcement strip 1100, while the trough region 1150 may touch or nearly touch the surface. Moreover, although depicted as having two peaks, it is contemplated herein that the reinforcement strip 1140 may comprise multiple peaks separated by multiple trough regions. Any and all aspects, and any variation thereof, are contemplated as being within the scope herein. Besides the shape configurations shown in FIGS. 11A-11C, other shape configurations for the reinforcement strip are contemplated herein such as half-circle shapes, half-diamond shapes, and the like.

Returning now to FIG. 1, because of the arched shape of the reinforcement strip 136, the midpoint of the first and second inflow air ducts 120 and 122 may extend a distance away from the outer-facing surface of the apparel item 100. In exemplary aspects, the midpoint of the first and second inflow air ducts 120 and 122 may extend away from the fabric surface of the apparel item 100 in the range of 0.5 cm to 2.5 cm, 1.0 cm to 2.0 cm, and/or between 1.3 cm to 1.8 cm, although values above and below these ranges are contemplated herein.

Figure 8:
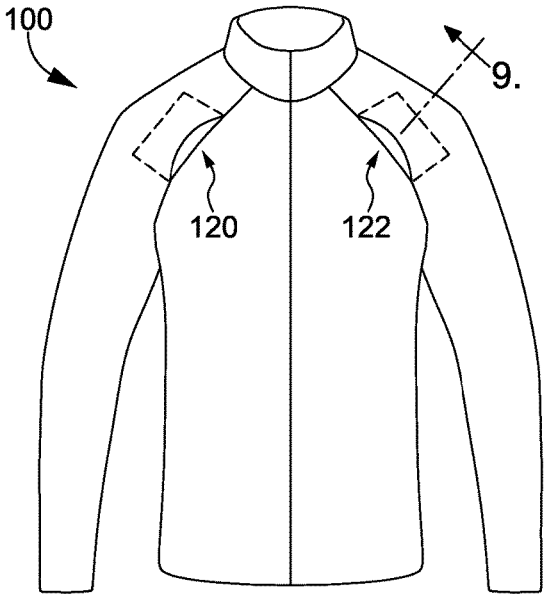
FIG. 8 depicts a front view of an exemplary apparel item having an alternative configuration for the integrated duct system in accordance with aspects herein.
Figure 9:
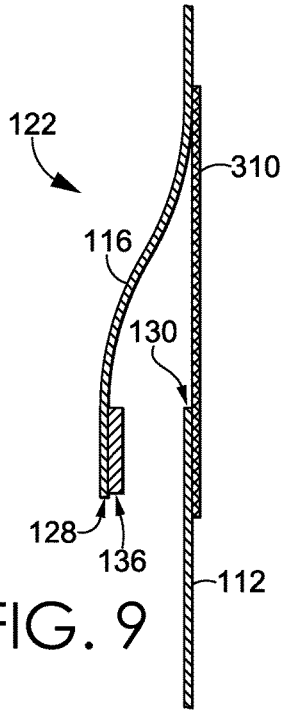
FIG. 9 depicts a cross-sectional view taken along cut line 9 of FIG. 8 in accordance with aspects herein.

A cross-sectional view of the second inflow air duct 122 taken along cut line 3 is shown in FIG. 3 in accordance with aspects herein. The first inflow air duct 120 would have a similar cross-sectional view and the discussion of FIG. 3 is equally applicable to the first inflow air duct 120. As shown, the reinforcement strip 136 is affixed to the front edge 128 of the left sleeve panel 116. In exemplary aspects, the reinforcement strip 136 may be affixed via stitching, bonding, adhesives, welding, and the like. As shown in FIG. 3, the edge of the reinforcement strip 136 may extend beyond the front edge 128 such that it is visible when viewing the apparel item 100 from the front as seen in FIG. 1. In other exemplary aspects, and as shown in FIG. 9, the edge of the reinforcement strip 136 may generally lie flush with the front edge 128. Or the front edge 128 of the left sleeve panel 116 may extend beyond the edge of the reinforcement strip 136 and may wrap around the edge of the reinforcement strip 136. With respect to this exemplary aspect, the reinforcement strip 136 may not be visible when viewing the apparel item 100 from the front as shown in FIG. 8. Any and all aspects, and any variation thereof, are contemplated as being within the scope herein.

Returning to FIG. 3, because the cross-section is taken at the approximate midpoint of the strip 136, the front edge 128 of the left sleeve panel 116 is offset or extends away from the front left panel 112 by a distance 312. As explained above, the distance 312 may be in the range of 0.5 cm to 2.5 cm, 1.0 cm to 2.0 cm, and/or between 1.3 cm to 1.8 cm, although values above and below these ranges are contemplated herein.

In an exemplary aspect, a perforated backing 310 may be affixed to front left panel 112 and the left sleeve panel 116 in the area of the second inflow air duct 122. This is indicated by the dashed line 138 in FIG. 1. The perforated backing 310 is configured to have sufficient permeability to enable air entering the second inflow air duct 122 to flow into the interior of the apparel item 100 but also is useful in preventing particles or debris from the external environment from entering. In exemplary aspects, the perforated backing 310 may comprise a mesh material, a perforated fabric, and the like.

Figure 5A:
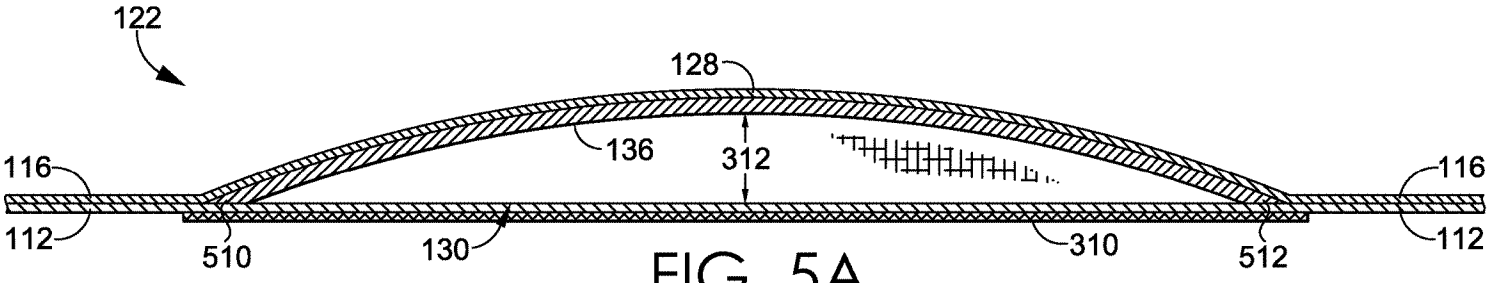
FIG. 5A depicts a face view of an exemplary air duct in accordance with aspects herein.
Figure 5B:
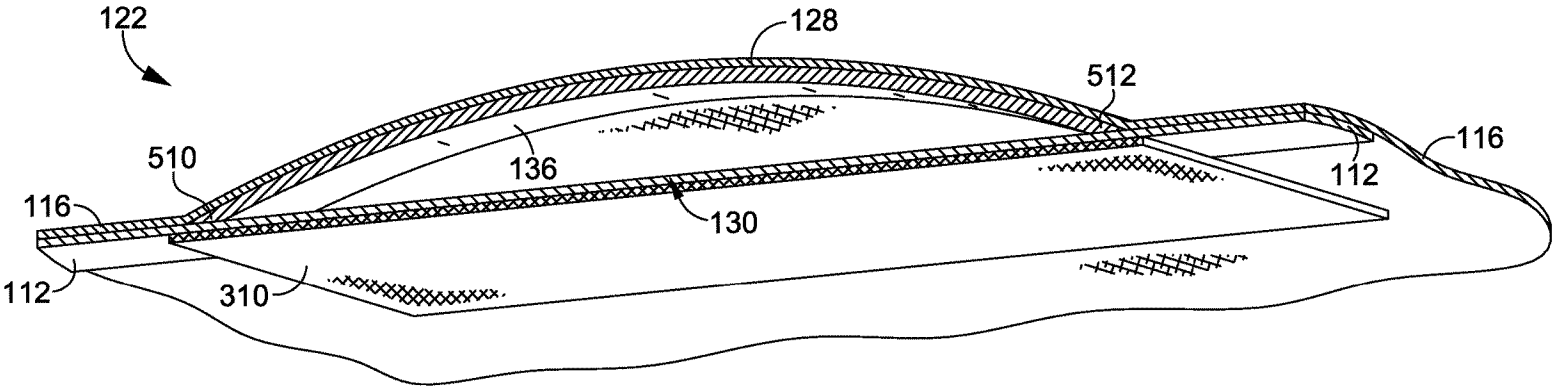
FIG. 5B depicts a perspective view of the exemplary air duct of FIG. 5A in accordance with aspects herein.

FIGS. 5A and 5B depict another view of the second inflow air duct 122 taken along cut line 5-5 of FIG. 3 in accordance with aspects herein. FIG. 5A is a face view while FIG. 5B is a perspective view. The discussion of FIGS. 5A and 5B would be equally applicable to the first inflow air duct 120 or other inflow and/or outflow air ducts described herein. As shown in FIGS. 5A and 5B, the second inflow air duct 122 has an arched shaped due to the configuration of the reinforcement strip 136 affixed along the length of the front edge 128 of the left sleeve panel 116 causing the approximate midpoint of the front edge 128 to extend away from the front left panel 112 by the distance 312. The first and second ends 510 and 512 of the strip 136 are shown as being tapered similar to the tapering of the ends 1110 and 1112 in FIG. 11. In exemplary aspects, the first and second ends 510 and 512 of the reinforcement strip 136 may be affixed to both the front edge 128 of the left sleeve panel 116 and the upper edge 130 of the front left panel 112. This may help to further secure the reinforcement strip 136 to the apparel item 100. Moreover, the tapering of the first and second ends 510 and 512 may help to create a smoother transition between the strip 136 and the panels 116 and 112.

As shown in FIG. 5A, the perforated backing 310 is affixed to an inner-facing surface of the front left panel 112. And as shown in FIG. 3 and in FIG. 5B, the perforated backing 310 is also affixed to an inner-facing surface of the left sleeve panel 116. The perforated backing 310 has a generally rectangular shape such that it forms the floor of the second inflow air duct 122 as shown in FIG. 5B, although other shape configurations are contemplated herein. A similar configuration would hold true for the first inflow air duct 120.

Figure 6:
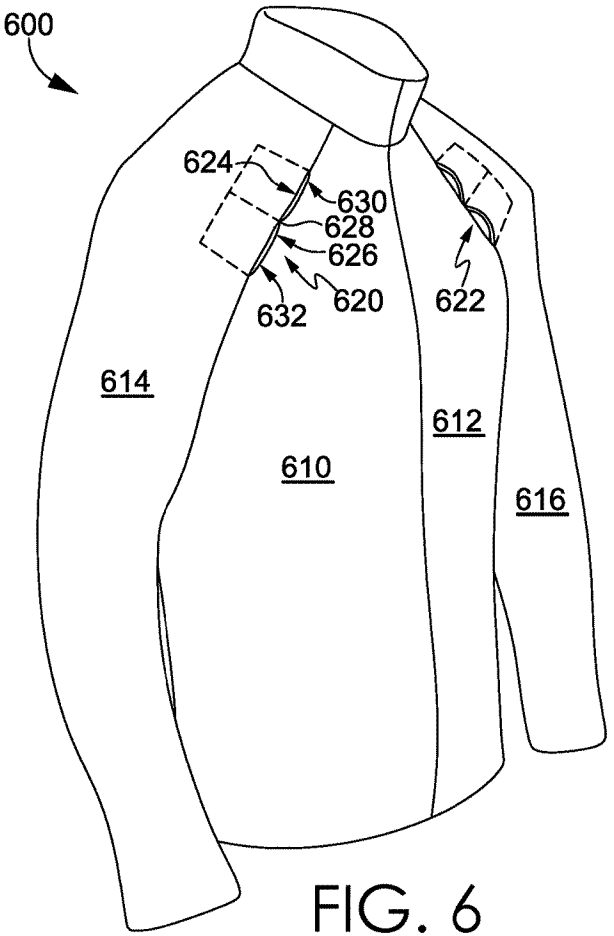
FIG. 6 depicts a front perspective view of the exemplary apparel item of FIG. 1 illustrating an alternative configuration for the inflow air ducts in accordance with aspects herein.

Turning now to FIG. 6, FIG. 6 depicts some alternative configurations for the inflow air ducts 120 and 122 in accordance with aspects herein. FIG. 6 depicts a front perspective view of an apparel item 600 having a front right panel 610, a front left panel 612, a right sleeve panel 614, and a left sleeve panel 616. The apparel item 600 further comprises a first inflow air duct 620 and a second inflow air duct 622. Similar to the first and second inflow air ducts 120 and 122, the first inflow air duct 620, in exemplary aspects, is formed by permanently and discontinuously affixing a front edge 624 of the right sleeve panel 614 to an upper edge 626 of the front right panel 610. As shown in FIG. 6, instead of a single opening being formed as with the first inflow air duct 120 of the apparel item 100, the first inflow air duct 620 comprises two separate air ducts 630 and 632 separated by an affixed area as indicated by the reference numeral 628. The affixed area 628 represents the area where the front edge 624 of the right sleeve panel 614 is affixed to the upper edge 626 of the front right panel 610. A similar configuration is shown for the second inflow air duct 622. Thus, a single inflow air duct may be sub-divided into one or more additional "sub-air ducts" such as the air duct 630 and the air duct 632, by affixing the panels together at one or more points along the opening of the inflow air duct. The creation of "sub-air ducts" may also be due to use of a reinforcement strip having a configuration similar to, for example, the reinforcement strip 1120 and/or the reinforcement strip 1140. The configuration described for FIG. 6 may also be applicable for other inflow air ducts as described herein.

FIGS. 14, 15A-15B, 16, and 17 depict some alternative configurations and locations for inflow air ducts for exemplary apparel items in accordance with aspects herein. With respect to FIG. 14, a front view of an exemplary apparel item 1400 is shown having an upper right front panel 1410, an upper left front panel 1412, a lower right front panel 1414, a lower left front panel 1416, a right sleeve panel 1418, and a left sleeve panel 1420. Although shown as long sleeves, it is contemplated herein that the right sleeve panel 1418 and the left sleeve panel 1420 may comprise three-quarter sleeves, half-sleeves, quarter sleeves, and the like. It is further contemplated herein, that the apparel item 1400 may take the form of a vest having no sleeves. Any and all aspects, and any variation thereof, are contemplated as being within the scope herein.

In exemplary aspects, a lower edge 1426 of the upper right front panel 1410 may be permanently and discontinuously affixed to an upper edge 1428 of the lower right front panel 1414 to form a first inflow air duct 1422. Similarly, a lower edge 1430 of the upper left front panel 1412 may be permanently and discontinuously affixed to an upper edge 1432 of the lower left front panel 1416 to form a second inflow air duct 1424.

Figure 14:
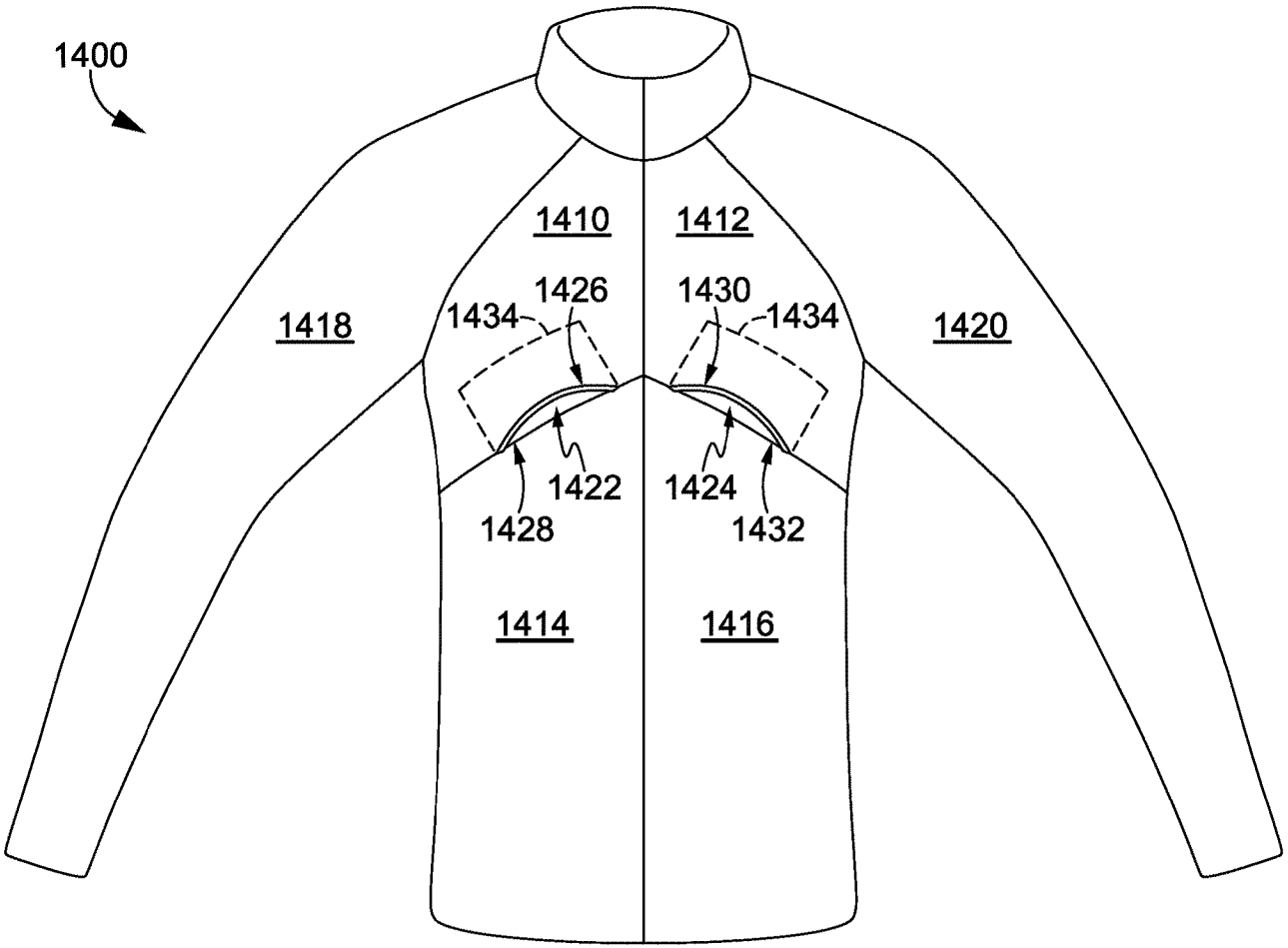
FIG. 14 depicts a front view of an alternative configuration for an inflow air duct system for an exemplary apparel item in accordance with aspects herein.

As shown in FIG. 14, the first and second inflow air ducts 1422 and 1424 may be skewed from a vertical axis. For instance, in exemplary aspects, the first inflow air duct 1422 may be skewed in a positive direction from a vertical axis bisecting the first inflow air duct 1422 by, for example, +40 degrees, +50 degrees, +60 degrees, +70 degrees, and/or +80 degrees, although values above and below these are contemplated herein. For example, the upper right front panel 1410 and the lower right front panel 1414 may be configured such that the first inflow air duct 1422 may be substantially horizontal. With respect to the second inflow air duct 1424, the second inflow air duct 1424 may be skewed in a negative direction from a vertical axis bisecting the second inflow air duct 1424 by, for example, −40 degrees, −50 degrees, −60 degrees, −70 degrees, and/or −80 degrees, although values above and below these are contemplated herein. For example, the upper left front panel 1412 and the lower left front panel 1416 may be configured such that the second inflow air duct 1424 may be substantially horizontal. The opening length of the first and second inflow air ducts 1422 and 1424 may be similar to the dimensions provided for the first and second inflow air ducts 120 and 122 of the apparel item 100.

In exemplary aspects, each of the first and second inflow air ducts 1422 and 1424 may have a reinforcement strip, such as any of the reinforcement strips depicted in FIGS. 11A-11C, affixed to its superior margin. For instance, a reinforcement strip may optionally be affixed to the lower edge 1426 of the upper right front panel 1410 and to the lower edge 1430 of the upper left front panel 1412 as shown in FIG. 14. As described above, the reinforcement strip may be useful for maintaining the first and second inflow air ducts 1422 and 1424 in a permanently open position. Moreover, each of the first and second inflow air ducts 1422 and 1424 may further comprise a perforated backing, as indicated by the reference numeral 1434, similar to the perforated backing 310 shown in, for example, FIG. 3.

Figure 16:
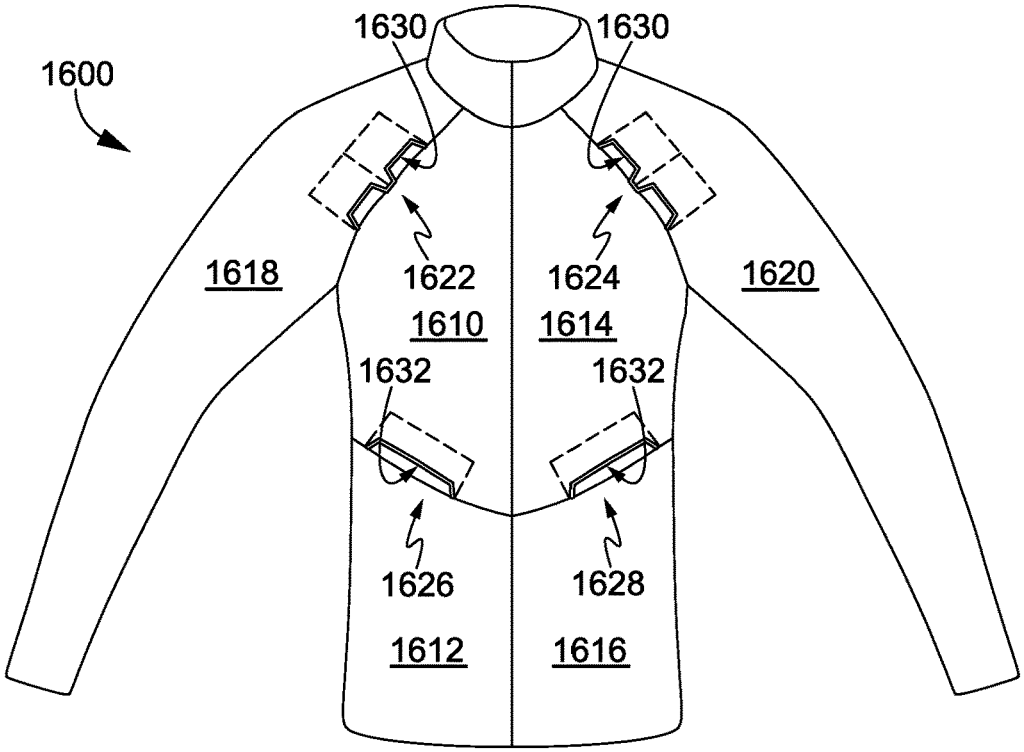
FIG. 16 depicts a front view of an alternative configuration for an inflow air duct system for an exemplary apparel item in accordance with aspects herein.

Besides the front panels 1410, 1412, 1414, and 1416 shown in FIG. 14, it is contemplated herein that the apparel item 1400 may comprise additional front panels. Moreover, it is contemplated herein that multiple inflow air ducts may be formed between the edges of one or more of the front panels. For example, FIG. 16 depicts an apparel item 1600 comprising at least an upper right front panel 1610 and a lower right front panel 1612, an upper left front panel 1614 and a lower left front panel 1616, a right sleeve panel 1618, and a left sleeve panel 1620. A first inflow air duct 1622 is formed between a front edge of the right sleeve panel 1618 and an upper edge of the upper right front panel 1610, and a second inflow air duct 1624 is formed between a front edge of the left sleeve panel 1620 and an upper edge of the upper left front panel 1614. The first and second inflow air ducts 1622 and 1624 may have an orientation similar to the first and second inflow air ducts 120 and 122 of the apparel item 100 (e.g., they may be skewed from a vertical axis bisecting the ducts 1622 and 1624 in the ranges disclosed for the air ducts 120 and 122 respectively). Moreover, in an exemplary aspect, the first and second inflow air ducts 1622 and 1624 may be reinforced with a reinforcement strip 1630 having a configuration similar to, for example, the reinforcement strip 1120 of FIG. 11B. The trough region of the reinforcement strip 1630 may or may not be affixed to the upper edges of the upper right and upper left front panels 1610 and 1614 in exemplary aspects. Further, it is contemplated herein that a reinforcement strip having a different configuration than the reinforcement strip 1630 may be utilized herein.

As well, the apparel item 1600 may comprise a third inflow air duct 1626 formed between a lower edge of the upper right front panel 1610 and an upper edge of the lower right front panel 1612, and a fourth inflow air duct 1628 formed between a lower edge of the upper left front panel 1614 and the upper edge of the lower left front panel 1616. In an exemplary aspect, the third inflow air duct 1626 may have an orientation that is opposite to that of the first inflow air duct 1622. That is, the third inflow air duct 1626 may be skewed in the negative direction from a vertical axis bisecting the third inflow air duct 1626. In exemplary aspects, the third inflow air duct 1626 may be skewed −30 degrees, −40 degrees, −50 degrees, −60 degrees, −70 degrees, or −80 degrees from the vertical axis although degrees of skewing above and below these values are contemplated herein.

Similarly, the fourth inflow air duct 1628 may have an orientation that is opposite to that of the second inflow air duct 1624. For instance, the fourth inflow air duct 1628 may be skewed in the positive direction from a vertical axis bisecting the fourth inflow air duct 1628. In exemplary aspects, the fourth inflow air duct 1628 may be skewed +30 degrees, +40 degrees, +50 degrees, +60 degrees, +70 degrees, or +80 degrees from the vertical axis although degrees of skewing above and below these values are contemplated herein. By having different orientations for the inflow air ducts 1622, 1624, 1626, and 1628, opportunities to capture and funnel air flowing over and up the front of the apparel item 100 are increased.

Continuing, the third and fourth inflow air ducts 1626 and 1628 may optionally be reinforced with a reinforcement strip 1632 having a half-square configuration although other shape configurations are contemplated herein.

Figure 15A:
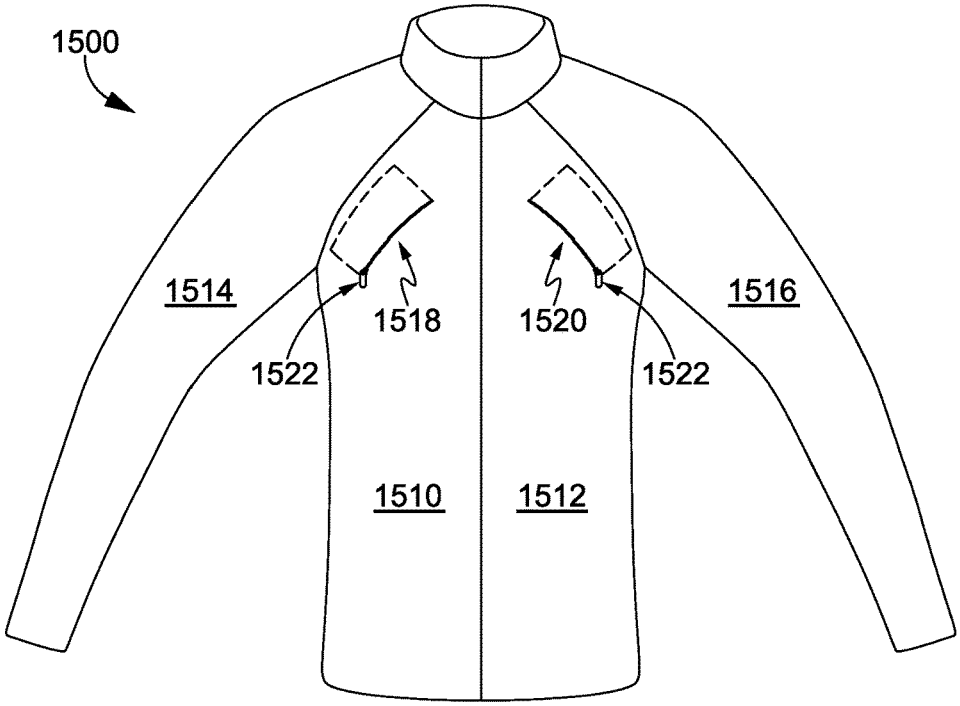
FIGS. 15A-15B depict a front view of an alternative configuration for an inflow air duct system for an exemplary apparel item in accordance with aspects herein.
Figure 15B:
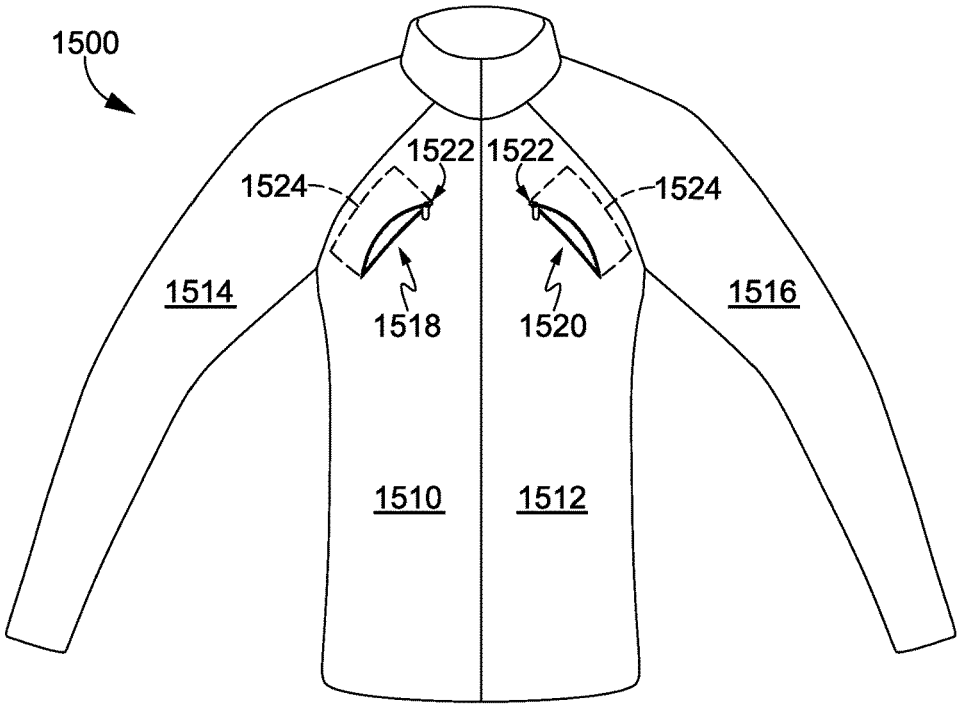

FIGS. 15A and 15B depict yet another alternative configuration for inflow air ducts for an exemplary apparel item in accordance with aspects herein. With respect to FIG. 15A, FIG. 15A depicts a front view of an exemplary apparel item 1500 having, for example, a right front panel 1510, a left front panel 1512, a right sleeve panel 1514, and a left sleeve panel 1516. Although the right and left sleeve panels 1514 and 1516 are shown as comprising full-length sleeves, it is contemplated herein that the sleeves may comprise three-quarter sleeves, half-sleeves, quarter sleeves, and even no sleeves. Moreover, it is further contemplated herein, that the apparel item 1500 may comprise additional front panels other than those shown.

The apparel item 1500 comprises a first inflow air duct 1518 and a second inflow air duct 1520 in a closed state in accordance with aspects herein. In one exemplary aspect, the first inflow air duct 1518 and the second inflow air duct 1520 may be formed by incising the right front panel 1510 and the left front panel 1512 respectively to form an opening, and using some type of re-sealable fastener 1522 to maintain the first and second inflow air ducts 1518 and 1520 in an open state, a closed state, or an intermediate state. In another exemplary aspect, the first inflow air duct 1518 and the second inflow air duct 1520 may be formed in a manner similar to the inflow air ducts for the apparel item 100 and/or the apparel item 1400. For example, the first and second inflow air ducts 1518 and 1520 may be formed by permanently and discontinuously affixing panel edges together to form the ducts 1518 and 1520 and employing the re-sealable fastener 1522 to maintain the ducts 1518 and 1520 in an open state, a closed state, or an intermediate state.

Continuing, in exemplary aspects, the re-sealable fastener 1522 may comprise a zipper, buttons, hook-and-eyes, snaps, hook-and-loop fasteners, a releasable adhesive, and the like. The location of the first and second inflow air ducts 1518 and 1520 on the front of the apparel item 1500 is exemplary only, and it is contemplated herein that the ducts 1518 and 1520 may be located in other areas of the right front panel 1510 and the left front panel 1512 and/or may have different orientations than those shown.

FIG. 15B illustrates the first inflow air duct 1518 and the second inflow air duct 1520 in an open state in accordance with aspects herein. For instance, the first and second inflow air ducts 1518 and 1520 may be opened via the re-sealable fastener 1522. As shown in FIG. 15B, a perforated backing 1524 similar to the perforated backing 310 of FIG. 3 may line the first and second inflow air ducts 1518 and 1520, where the backing 1524 may have sufficient permeability to let air flow through but prevent particulate matter from entering the ducts 1518 and 1520.

In exemplary aspects, the first and second inflow air ducts 1518 and 1520 may be selectively opened or closed via the re-sealable fastener 1522 to provide varying levels of ventilation. For instance, only one of the inflow air ducts 1518 or 1520 may be opened, or both may be partially opened to provide a lower level of ventilation to the apparel item 1500. This may be useful when the wearer is resting or is not in an active state. However, both the first and second inflow air ducts 1518 and 1520 may be completely opened to provide a greater degree of ventilation in response to, for example, the wearer engaging in athletic activities. Any and all aspects, and any variation thereof, are contemplated as being within the scope herein.

Figure 17:
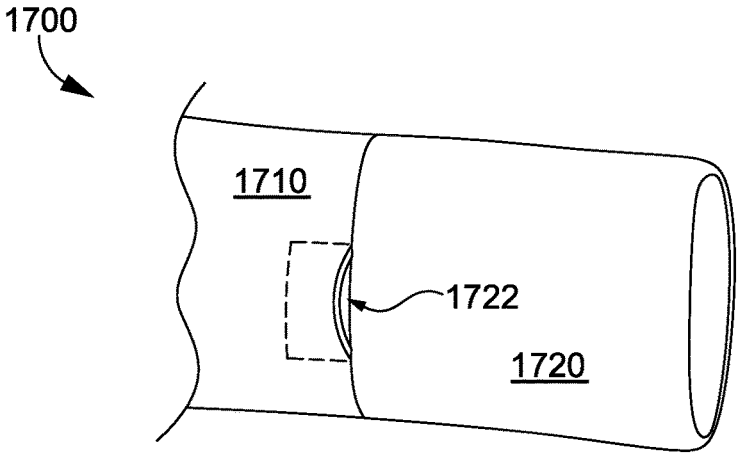
FIG. 17 is a partial view of an air duct located on a sleeve of an exemplary apparel item having an integrated duct ssystem in accordance with aspects herein.

FIG. 17 depicts yet another configuration for inflow air ducts in accordance with aspects herein. FIG. 17 is a partial view of a sleeve 1700 of an exemplary apparel item described herein. In this exemplary aspect, the sleeve 1700 comprises an upper or proximal sleeve panel 1710 and a lower or distal sleeve panel 1720. An inflow air duct 1722 is formed by permanently and discontinuously affixing a distal edge of the proximal sleeve panel 1710 to a proximal edge of the distal sleeve panel 1720. In exemplary aspects, the inflow air duct 1722 may be reinforced with a reinforcement strip. The inflow air duct 1722 may be oriented on the sleeve 1700 to effectively capture and funnel air flowing over the front of the apparel item. In exemplary aspects, the inflow air duct 1722 may be located on a lateral and/or medial side of the sleeve 1700. This location may be advantageous when the wearer engages in a running motion where the arms are bent and the inflow air duct 1722 is effectively facing forward.

Turning now to FIG. 2A, the back of the apparel item 100 comprises an outflow air duct 216 that is formed by permanently and discontinuously affixing a lower edge 218 of the upper back panel 210 to an upper edge 220 of the lower back panel 212. More specifically, the lower edge 218 of the upper back panel 210 is permanently joined to the upper edge 220 of the lower back panel 212 at the areas indicated by reference numerals 222 and 224 but is maintained separate from the upper edge 220 at the outflow air duct 216.

In exemplary aspects, the outflow air duct 216 is oriented in a generally horizontal direction and extends across the midline of the back panel 214. When the apparel item 100 is in the as-worn configuration, the outflow air duct 216 is adapted to generally lie along a mid-thoracic area of the wearer. For example, the outflow air duct 216 may be configured to lie approximately 20 to 30 cm below the neckline of the apparel item 100. In exemplary aspects, the outflow air duct 216 may have an opening length in the range of 20 cm to 40 cm, 25 cm to 35 cm, and/or between 28 cm and 32 cm, although lengths above and below these ranges are contemplated herein. The location and the length of the outflow air duct 216 is exemplary only, and it is contemplated herein that the outflow air duct 216 may be positioned above and/or below the location shown in FIG. 2A, and that the outflow air duct 216 may have a length greater or less than that shown. Any and all aspects, and any variation thereof, are contemplated as being within the scope herein.

Although not clearly shown in FIG. 2A, the lower edge 218 of the upper back panel 210 may be reinforced with a rigid or semi-rigid reinforcement strip having one of the exemplary configurations shown in FIGS. 11A-11C. In this particular view, the reinforcement strip has an arched-shaped configuration. The arched shape of the reinforcement strip causes the upper back panel 210 to extend out and away from the lower back panel 212 in the area of the outflow air duct 216. This is shown more clearly in FIG. 2B which is a right side view of the apparel item 100. As shown in FIG. 2B, the lower edge 218 of the upper back panel 210 extends away from the upper edge 220 of the lower back panel 212 a predetermined distance. In exemplary aspects, the predetermined distance may be in the range of 3 cm to 7 cm, 4 cm to 6 cm, and/or between 4.5 cm and 5.5 cm although distances above and below these values are contemplated as being within the scope herein. The horizontal orientation of the outflow air duct 216 combined with the use of the reinforcement strip effectively creates a downward-facing scoop having an aerofoil-type shape. The benefits of this shape will be detailed below. The aerofoil-type shape shown in FIG. 2B may be augmented by air flowing out of the outflow air duct 216. Passage of this air may cause the outflow air duct 216 to expand or insufflate to further create the downward-facing scoop shape.

Figure 4:
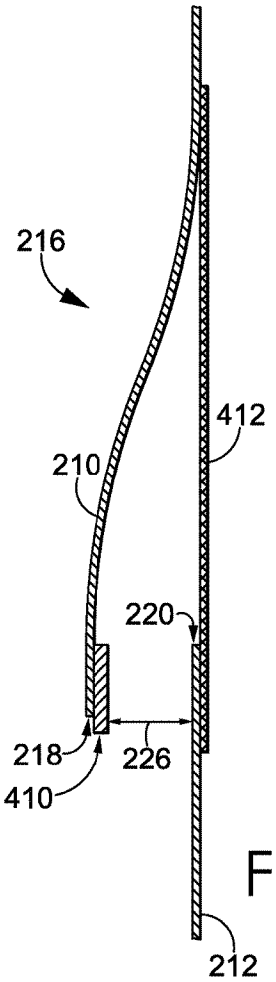
FIG. 4 depicts a cross-sectional view taken along cut line 4 of FIG. 2A illustrating an outflow air duct of the integrated duct system in accordance with aspects herein.

FIG. 4 depicts a cross-sectional view of the outflow air duct 216 along cut line 4 in accordance with aspects herein. A reinforcement strip 410 is affixed to the lower edge 218 of the upper back panel 210. As shown in FIG. 4, the edge of the reinforcement strip 410 may extend beyond the lower edge 218 such that it is visible when viewing the back of the apparel item 100. In other exemplary aspects, the edge of the reinforcement strip 410 may lie flush with the lower edge 218 (this would be similar to the configuration depicted in FIG. 9). Or the lower edge 218 of the upper back panel 210 may extend beyond the edge of the reinforcement strip 410 and may wrap around the edge such that the reinforcement strip 410 is not visible when viewing the back of the apparel item 100. Any and all aspects, and any variation thereof, are contemplated as being within the scope herein.

The reinforcement strip 410 may be the exemplary reinforcement strip 1100, 1120, or 1140 depicted in FIGS. 11A-11C, and the discussion regarding those reinforcement strips is equally applicable to the reinforcement strip 410. In exemplary aspects, the reinforcement strip 410 may be affixed along the length of the lower edge 218 via stitching, bonding, adhesives, welding, and the like. Because the cross-section is taken at the approximate midpoint of the strip 410, the lower edge 218 of the upper back panel 210 is offset or extends away from the lower back panel 212 by a distance 226. As explained above, the distance 226 may be in the range of 3 cm to 7 cm, 4 cm to 6 cm, and/or between 4.5 cm and 5.5 cm although distances above and below these values are contemplated as being within the scope herein.

In an exemplary aspect, a perforated backing 412 may be affixed to the lower back panel 212 and the upper back panel 210 in the area of the outflow air duct 216. More specifically, the perforated backing 412 may be affixed to an inner-facing surface of the upper edge 220 of the lower back panel 212 at an opening side of the outflow air duct 216 and to an inner-facing surface of the upper back panel 210 at the back edge of the outflow air duct 216. Like the perforated backing 310, the perforated backing 412 may have a generally rectangular shape and forms the floor of the outflow air duct 216, although other shape configurations are contemplated herein. This is similar to the configuration shown in FIG. 5B and is indicated by the dashed line 228 in FIG. 2A. The perforated backing 412 has sufficient permeability to enable air within the apparel item 100 to exit the apparel item 100 via the outflow air duct 216 but also is useful in preventing particles and debris from the external environment from entering the apparel item 100.

Figure 7:
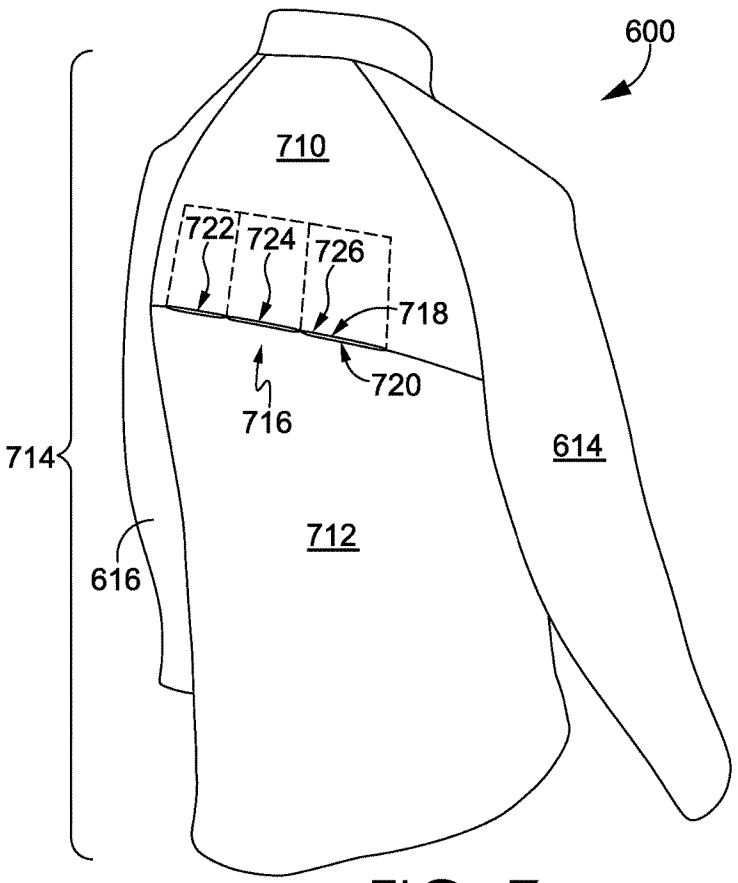
FIG. 7 depicts a back perspective view of the exemplary apparel item of FIG. 1 illustrating an alternative configuration for the outflow air duct in accordance with aspects herein.

Turning now to FIG. 7, a back perspective view of the apparel item 600 of FIG. 6 is shown in accordance with aspects herein and is used to illustrate different configurations for the outflow air duct. Similar to the apparel item 100, the apparel item 600 comprises an upper back panel 710 and a lower back panel 712 that together form the back panel 714. An outflow air duct 716 is formed by permanently and discontinuously affixing a lower edge 718 of the upper back panel 710 to an upper edge 720 of a lower back panel 712 at one or more points along the outflow air duct 716. In this depiction, the outflow air duct 716 has been subdivided into three sub-air ducts 722, 724, and 726. In exemplary aspects, the sub-air ducts 722, 724, and 726 may also be created by using a reinforcement strip having a "three-peak" or "three-plateau" configuration.

The configurations shown in FIGS. 6 and 7 are exemplary only and it is contemplated herein that the inflow and outflow air ducts 620, 622, and 716 may be sub-divided into more or less sub-air ducts. Additionally it is contemplated herein, that the inflow air ducts 620 and 622 may not be sub-divided while the outflow air duct 716 is sub-divided or vice versa. Further, it is contemplated herein that each of the sub-air ducts may have its own perforated backing as shown by the dashed lines in FIGS. 6 and 7, or a single perforated backing may be used that spans all the sub-air ducts. Any and all aspects, and any variation thereof, are contemplated as being within the scope herein.

Figure 12:
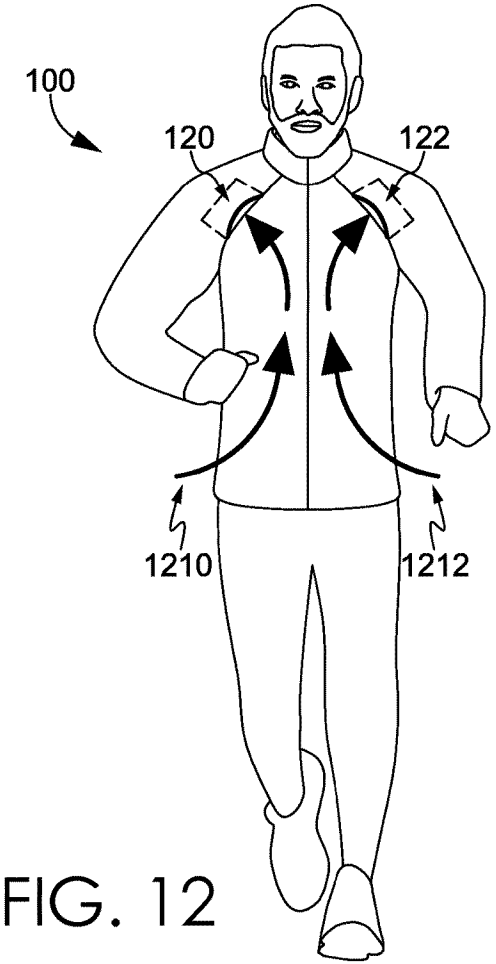
FIG. 12 depicts an exemplary air flow pattern over a front portion of an exemplary apparel item having an integrated duct system in accordance with aspects herein.

The configuration of the first and second inflow air ducts as described herein combined with the orientation of the inflow air ducts may help to create a scoop-like configuration that maximizes the opportunity to capture and funnel air traveling over and up the front of the apparel item, such as the apparel item 100, the apparel item 600, the apparel item 1400, the apparel item 1500, and/or the apparel item 1600. The scoop-like configuration may be augmented by use of the reinforcement strip attached to the upper or superior margin of the inflow air ducts. As described earlier, running or jogging motions in a forward direction often produce an air flow pattern where the air travels over and up the front of the apparel item. An exemplary air flow pattern produced by this motion is shown in FIG. 12. FIG. 12 depicts a front view of a wearer wearing, for instance, the apparel item 100 and exhibiting a running-type motion. Air flow streams 1210 and 1212 travel over and up the front of the apparel item 100 and are effectively captured and funneled into the interior of the apparel item 100 by the first and second inflow air ducts 120 and 122. Any air flow that is not captured by the first and second inflow air ducts 120 and 122 may continue to travel over the shoulders of the wearer and potentially over the back of the apparel item 100.

Figure 13:
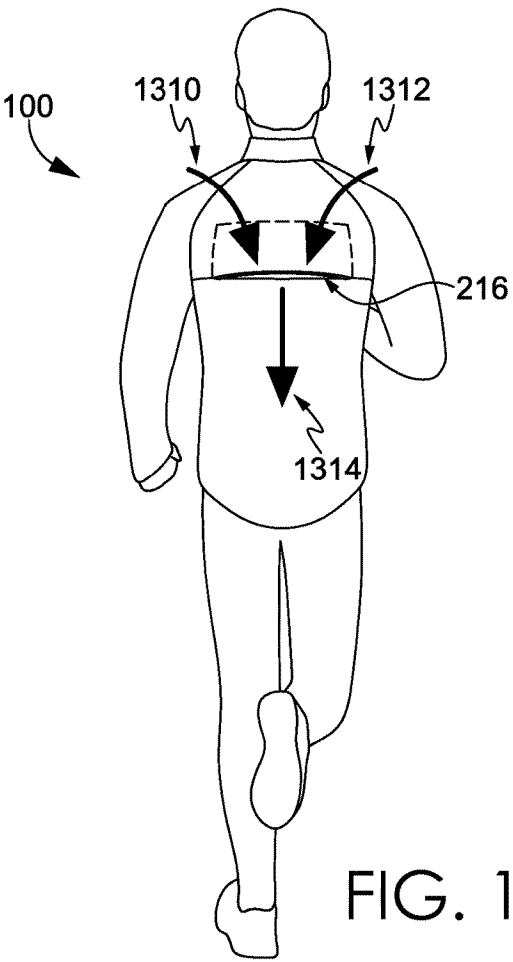
FIG. 13 depicts an exemplary air flow pattern over a back portion of the exemplary apparel item having the integrated duct system of FIG. 12 in accordance with aspects herein.

Continuing, the arched-shape configuration of the outflow air duct 216 along with its opening length and its horizontal orientation further helps to create at least two effective air flow patterns that help to draw air out of the apparel item, such as the apparel item 100, the apparel item 600, the apparel item 1400, and/or the apparel item 1500, thereby helping to cool the wearer and to remove moisture vapor that builds up within the apparel item. For example, FIG. 13 depicts a back view of the wearer wearing the apparel item 100 of FIG. 12 and is used to illustrate exemplary air flow patterns in accordance with aspects herein. In one exemplary aspect, the outflow air duct 216 is configured to have a longer length and a wider opening (e.g., the distance 226 as shown in FIG. 4) than the first and second inflow air ducts 120 and 122, thus providing a substantially larger egress or exit point for air to leave the apparel item 100 as compared to the ingress or entrance point for air entering the apparel item 100. Because of the relatively small openings associated with the first and second inflow air ducts 120 and 122 and because air is being forced into the ducts 120 and 122 by the forward movement of the wearer, a positive pressure is generated at the first and second inflow air ducts 120 and 122. By contrast, because of the larger opening of the outflow air duct 216 and because air is not being forced into the duct 216 due to the wearer's forward motion, a negative pressure is generated at the outflow air duct 216. A pressure differential is thus created between the first and second inflow air ducts 120 and 122 and the outflow air duct 216 causing air within the apparel item 100 to move through the apparel item 100 and flow out of the apparel item 100 at the outflow air duct 216 as indicated by the air flow arrow 1314 of FIG. 13.

Still referring to FIG. 13, another exemplary air flow pattern may also be created due to the downward-facing scoop configuration of the outflow air duct 216. As mentioned, this configuration causes the outflow air duct 216 to assume an aerofoil-type shape similar to an airplane wing. Air that is not captured by the first and second inflow air ducts 120 and 122 may continue to travel up and over the shoulders of the wearer. At least some of this air will travel over and down the back torso of the wearer as indicated by the arrows 1310 and 1312. The air then travels over the outwardly-projecting outflow air duct 216. Because of the aerofoil-type shape to the duct 216, according to Bernoulli's principle air will generally flow faster over the outer-facing surface of the outflow air duct 216 while air exiting the outflow air duct 216 as indicated by the arrow 1314 will likely move slower. The faster moving air causes a lower air pressure while the slower moving air causes a higher air pressure. The slower moving air as indicated by the arrow 1314 will attempt to speed up in order to equalize the pressure differential thereby further helping to draw or channel the air out of the apparel item 100 and helping to remove moisture vapor build-up within the apparel item 100.

Aspects of the present invention have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. An upper-body apparel item having an integrated air duct system, the upper-body apparel item comprising:

a plurality of panels including at least a right front panel, a left front panel, a right sleeve panel extending from the right front panel and adapted to cover a wearer's first arm, and a left sleeve panel extending from the left front panel and adapted to cover a wearer's second arm, each of the plurality of panels having a perimeter shape defined by at least one edge, wherein:

a front edge of the right sleeve panel is permanently and discontinuously affixed to an upper edge of the right front panel to form a first air duct, a front edge of the left sleeve panel is permanently and discontinuously affixed to an upper edge of the left front panel to form a second air duct, at the areas where the respective edges of the panels are discontinuously affixed together, at least one of the panel edges is reinforced with a reinforcement strip that extends along a length of the at least one of the panel edges, wherein the reinforcement strip is configured such that the respective air duct is permanently maintained in an open state, an opening of the first air duct is skewed in a positive direction with respect to a hypothetical vertical axis that bisects the first air duct, and an opening of the second air duct is skewed in a negative direction with respect to a hypothetical vertical axis that bisects the second air duct.

2. The upper-body apparel item of claim 1, wherein the plurality of panels further comprise an upper back panel and a lower back panel, and wherein a lower edge of the upper back panel is permanently and discontinuously affixed to an upper edge of the lower back panel to form:

a third air duct located at a back portion of the upper-body apparel item such that the third air duct extends across a midline of the back portion of the upper-body apparel item.

3. The upper-body apparel item of claim 1, wherein the first air duct and the second air duct provide an air flow communication path between an outer-facing surface of the upper-body apparel item and an inner-facing surface of the upper-body apparel item.

4. The upper-body apparel item of claim 1, wherein the reinforcement strip has at least a first end, a second end, and an intervening portion between the first end and the second end.

5. The upper-body apparel item of claim 4, wherein a mid-point of the reinforcement strip is offset from an outer-facing surface of the upper-body apparel item a greater distance than the first end and the second end of the reinforcement strip.

6. The upper-body apparel item of claim 5, wherein the first end and the second end of the reinforcement strip are flush with the outer-facing surface of the upper-body apparel item.

7. The upper-body apparel item of claim 1, wherein the reinforcement strip is formed from at least one of a nylon material, a thermoplastic polyurethane material, or a polyurethane material.

8. The upper-body apparel item of claim 1, wherein the reinforcement strip is affixed to the at least one of the panel edges by at least one of stitching, adhesive, or heat bonding.

9. An upper-body apparel item having an integrated air duct system, the upper-body apparel item comprising:

a right panel adapted to cover a front right torso area of a wearer;

a left front panel adapted to cover a front left torso area of the wearer;

a right sleeve panel extending from the right front panel and adapted to cover a wearer's first arm;

a left sleeve panel extending from the left front panel and adapted to cover a wearer's second arm;

a first air duct formed by permanently and discontinuously affixing a front edge of the right sleeve panel and an upper edge of the right front panel of the upper-body apparel item; and a second air duct formed by permanently and discontinuously affixing a front edge of the left sleeve panel and an upper edge of the left front panel of the upper-body apparel item, wherein:

an opening of the first air duct is skewed in a positive direction with respect to a hypothetical vertical axis that bisects the first air duct, and an opening of the second air duct is skewed in a negative direction with respect to a hypothetical vertical axis that bisects the second air duct.

10. The upper-body apparel item of claim 9, wherein the respective openings of the first air duct and the second air duct have a length between 7 and 15 centimeters.

11. The upper-body apparel item of claim 9, further comprising:

an upper back panel adapted to cover an upper back torso area of the wearer;

a lower back panel adapted to cover a lower back torso area of the wearer;

at least a third air duct located on a back portion of the upper-body apparel item, the third air duct formed by permanently and discontinuously affixing a lower edge of the upper back panel to an upper edge of the lower back panel.

12. The upper-body apparel item of claim 11, wherein the first air duct has the same length as the second air duct.

13. The upper-body apparel item of claim 12, wherein the third air duct has a longer length than the first air duct and the second air duct.

14. The upper-body apparel item of claim 9, wherein the upper-body apparel item is treated with a durable water repellent.

15. An upper-body apparel item having an integrated air duct system, the upper-body apparel item comprising:

a right front panel adapted to cover a right front torso area of a wearer;

a left front panel adapted to cover a left front torso area of the wearer;

an upper back panel adapted to cover an upper back area of the wearer;

a lower back panel adapted to cover a lower back area of the wearer;

a right sleeve panel extending from the right front panel and the upper back panel, the right sleeve panel adapted to cover a first arm of the wearer;

a left sleeve panel extending from the left front panel and the upper back panel, the left sleeve panel adapted to cover a second arm of the wearer;

a first air duct formed by permanently and discontinuously affixing a front edge of the right sleeve panel and an upper edge of the right front panel, wherein an opening of the first air duct is skewed in a positive direction with respect to a hypothetical vertical axis that bisects the first air duct;

a second air duct formed by permanently and discontinuously affixing a front edge of the left sleeve panel and an upper edge of the left front panel, where an opening of the second air duct is skewed in a negative direction with respect to a hypothetical vertical axis that bisects the second air duct; and at least a third air duct formed by permanently and discontinuously affixing a lower edge of the upper back panel and an upper edge of the lower back panel.

16. The upper-body apparel item of claim 15, wherein a durable water repellent finish is applied to an outer-facing surface of the upper-body apparel item.

17. The upper-body apparel item of claim 16, wherein one or more portions of the upper-body apparel item are formed from a woven fabric.

18. The upper-body apparel item of claim 15, further wherein the third air flow duct is horizontally oriented and extends across a midline of a back portion of the upper-body apparel item.

19. The upper-body apparel item of claim 15, wherein one or more of the first air duct, the second air duct, and the third air duct are subdivided into two or more sub-ducts.

* * * * *